US006008593A

United States Patent [19]

Ribarich

[11] Patent Number: 6,008,593

[45] **Date of Patent: *Dec. 28, 1999**

[54] CLOSED-LOOP/DIMMING BALLAST CONTROLLER INTEGRATED CIRCUITS

[75] Inventor: Thomas J. Ribarich, Laguna Beach, Calif.

[73] Assignee: International Rectifier Corporation, El Segundo, Calif.

[ * ] Notice: This patent is subject to a terminal disclaimer.

[21] Appl. No.: 09/022,554

[22] Filed: Feb. 12, 1998

Related U.S. Application Data

[60] Provisional application No. 60/037,924, Feb. 12, 1997, provisional application No. 60/037,926, Feb. 12, 1997, provisional application No. 60/061,846, Oct. 15, 1997, provisional application No. 60/061,862, Oct. 15, 1997, and provisional application No. 60/070,484, Jan. 5, 1998.

[51] Int. Cl.[6] ..... G05F 1/00

[52] U.S. Cl. ..... 315/307; 315/224; 315/244; 315/194; 315/DIG. 7; 315/DIG. 4

[58] Field of Search ..... 315/291, 307, 315/244, 224, 209 R, 194, DIG. 4, DIG. 7; 361/18, 58

[56] References Cited

U.S. PATENT DOCUMENTS

| | | | |
|---|---|---|---|
| 5,331,253 | 7/1994 | Counts | 315/209 R |
| 5,424,611 | 6/1995 | Moriarty, Jr. | 315/94 |
| 5,471,119 | 11/1995 | Ranganath et al. | 315/307 |
| 5,491,387 | 2/1996 | Saito | 315/307 |
| 5,525,872 | 6/1996 | Achten et al. | 315/291 |
| 5,539,281 | 7/1996 | Shackle et al. | 315/224 |
| 5,545,955 | 8/1996 | Wood | 315/224 |
| 5,717,295 | 2/1998 | Nerone | 315/307 |
| 5,719,472 | 2/1998 | Kachmarik et al. | 315/224 |
| 5,729,096 | 3/1998 | Liu et al. | 315/225 |
| 5,818,669 | 10/1998 | Mader | 361/18 |

FOREIGN PATENT DOCUMENTS

| | | |
|---|---|---|
| 62-249398 | 10/1987 | Japan . |
| 242396 | 3/1990 | Japan . |
| 2199797 | 8/1990 | Japan . |
| 2148595 | 12/1990 | Japan . |
| 349187 | 3/1991 | Japan . |
| 3156892 | 7/1991 | Japan . |
| 3169265 | 7/1991 | Japan . |
| 473893 | 3/1992 | Japan . |

*Primary Examiner*—Haissa Philogene
*Attorney, Agent, or Firm*—Ostrolenk, Faber, Gerb & Soffen, LLP

[57] ABSTRACT

A novel monolithic electronic ballast controller IC for driving two MOS gated power semiconductors, such as power MOSFETs or IGBTs, connected in a totem pole or half-bridge arrangement. Advantageously, the present invention provides programmable preheat time and current, programmable end-of-life protection, lamp fault protection, over-temperature protection. The first embodiment of the invention is a closed-loop ballast controller IC intended for multiple lamp configurations, with three current-sensing inputs and programmable lamp power. Closed-loop control is accomplished through phase control, or, more specifically, a phase-locked loop (PLL) around a resonant type output stage driving a fluorescent lamp. The second embodiment of the present invention has a similar architecture to that of the first embodiment, with some modifications which allow dimming down to low light levels.

14 Claims, 26 Drawing Sheets

| SETDET | LAMPIN | START | RESET |
|---|---|---|---|
| 0 | 0 | 0 | 0 |
| 0 | 1 | 0 | 0 |
| 1 | 0 | 0 | 1 |
| 1 | 1 | 1 | 0 |

CLOSED-LOOP/DIMMING BALLAST CONTROLLER INTEGRATED CIRCUITS

This application claims the benefit of U.S. Provisional Application Ser. No. 60/037,924, filed on Feb. 12, 1997, U.S. Provisional Application Ser. No. 60/037,926, filed on Feb. 12, 1997, U.S. Provisional Application Ser. No. 60/061,846, filed on Oct. 15, 1997, U.S. Provisional Application Ser. No. 60/061,862, filed on Oct. 15, 1997, and U.S. Provisional Application Ser. No. 60/070,484, filed on Jan. 5, 1998.

BACKGROUND OF THE INVENTION

1. Field of the Invention

The present invention relates to a gate driver circuit for MOS gated devices, and more specifically to a monolithic gate driver circuit for MOS gated devices, particularly those used in lamp ballast circuits.

2. Description of the Related Art

Electronic ballasts for gas discharge circuits have recently come into widespread use because of the availability of power MOSFET switching devices and insulated gate bipolar transistors ("IGBTs") to replace previously used power bipolar switching devices. Monolithic gate driver circuits, such as the IR2155 sold by International Rectifier Corporation and described in U.S. Pat. No. 5,545,955, have been devised for driving the power MOSFETs or IGBTs in electronic ballasts. The IR2155 gate driver IC offers significant advantages over prior circuits in that it is packaged in a conventional DIP or SOIC package and contains internal level shifting circuitry, undervoltage lockout circuitry, dead-time delay circuitry, and additional logic circuitry and inputs so that the driver can self-oscillate at a frequency determined by external resistors $R_T$ and $C_T$.

Although the IR2155 offers a vast improvement over prior ballast control circuits, it is an open-loop system. Moreover, it does not have programmable preheat or end-of-life functions, nor does it have lamp fault, over-temperature protection, or dimming control.

SUMMARY OF THE INVENTION

The present invention provides a novel monolithic electronic ballast controller IC which permits the driving of two MOS gated power semiconductors such as power MOSFET or IGBT, one designated as a "low side switch," the other designated as a "high side switch," the two switches being connected in a totem pole or half-bridge arrangement. Advantageously, the present invention provides programmable preheat time and current, programmable end-of-life protection, lamp fault protection, over-temperature protection.

The first embodiment of the invention is a closed-loop ballast controller IC intended for multiple lamp configurations, with three current-sensing inputs and programmable lamp power. The ballast controller IC of this embodiment of the invention can drive one, two (parallel or series), three (parallel), or four (series/parallel) lamps. Dimming is possible with this embodiment, but is not recommended down to ultra-low light levels (~10%) due to tolerances in lamp manufacturing.

Closed-loop control in the present invention is accomplished through phase control, or, more specifically, a phase-locked loop (PLL) around a resonant type output stage driving a fluorescent lamp. When regulating multiple lamps, the lamp drawing more power is the master, which allows for easy end-of-life detection and ballast shutdown.

The second embodiment of the present invention has a similar architecture to that of the first embodiment, with some modifications which allow dimming down to low light levels. The second embodiment includes a dimming interface for analog control, 0 to 5VDC of lamp brightness, and minimum and maximum brightness settings. This allows the dimming range of a specific lamp type to be adjusted to, for example, 10% to 100% brightness, with 0 volts corresponding to 10% and 5V corresponding to 100%. The second embodiment of the invention has only one current-sensing input, which allows one or two (series) lamps to be driven.

Both the first embodiment and the second embodiment include a VCO, programmable pre-heat time, programmable pre-heat current, over-current protection, additional shutdown input and a complete high and low side half-bridge driver.

Other features and advantages of the present invention will become apparent from the following description of the invention which refers to the accompanying drawings.

DETAILED DESCRIPTION OF THE PREFERRED EMBODIMENTS

The following is a detailed functional description of the overall architecture of two embodiments of the ballast IC controller of the present invention.

The first embodiment is a ballast controller IC suitable for multiple lamp configurations. The second embodiment is a ballast controller IC which is particularly adapted for low light level dimming.

Figure 1:
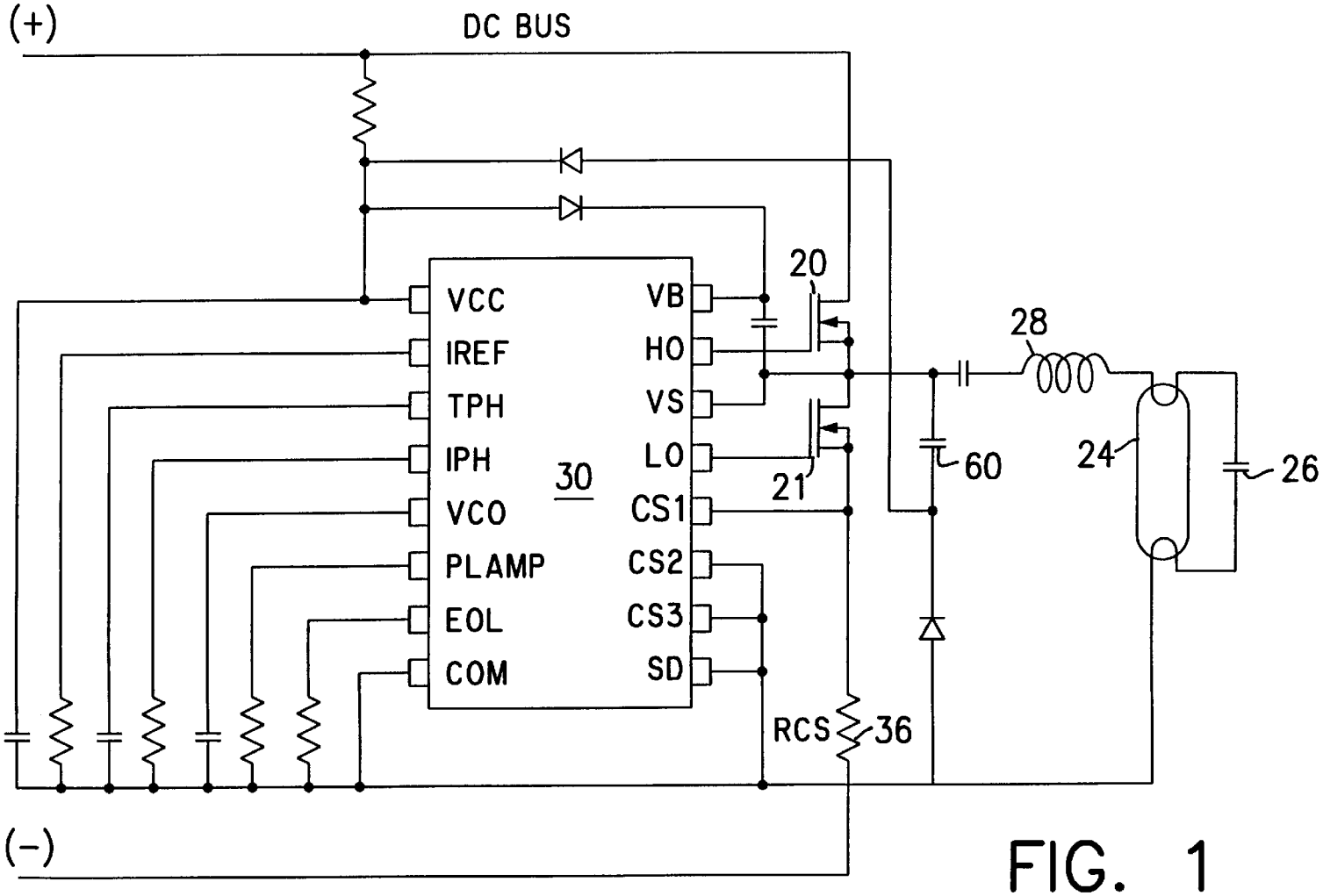
FIG. 1 is a typical connection diagram for the ballast IC driver of the first embodiment of the invention in a single lamp configuration.
Figure 2:
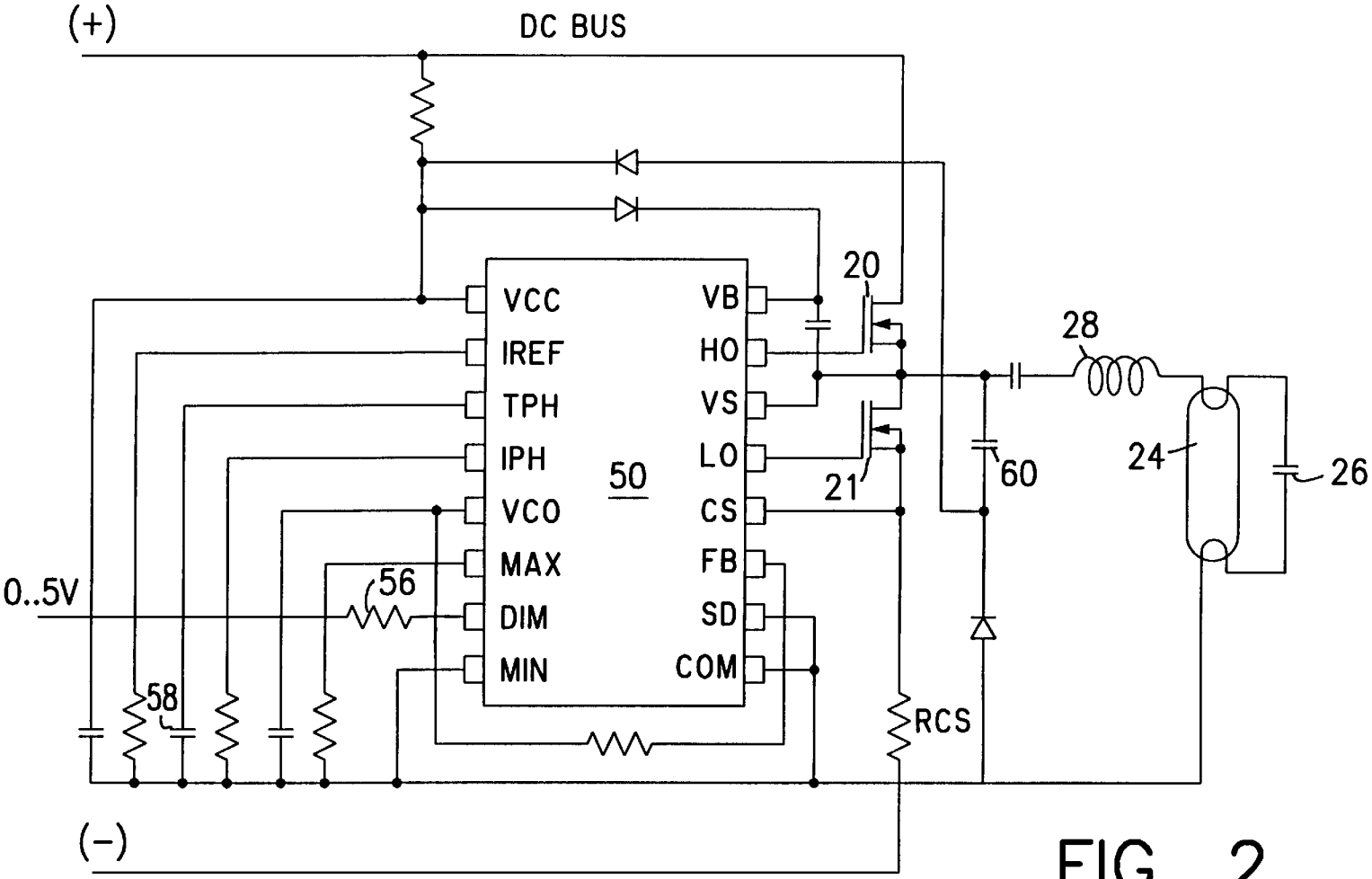
FIG. 2 is a typical connection diagram for the ballast IC driver of the second embodiment of the invention in a single lamp configuration.

Referring first to FIGS. 1 and 2, the typical connection schematics for the closed-loop ballast ICs of the first and second embodiments of the present invention, respectively, are shown. In each case, the ballast IC controls two power MOSFETs or IGBTs 20 and 21 connected in a "totem pole", a half-bridge circuit. The power MOSFETs/IGBTs 20 and 21 are driven by the ballast controller IC of the present invention to conduct alternatively via gate signals from pins HO and Lo, described below.

The output circuit, which is driven by the power supplied by MOSFETs/IGBTs 20 and 21, includes at least one gas discharge tube, typically a fluorescent lamp 24, which is connected in parallel with a capacitor 26 and in series with an inductor 28 to form a conventional lamp resonant circuit.

A description of the overall architecture of each of the two embodiments of the present invention is provided below, followed by a detailed description of the individual circuit blocks in each embodiment.

Overall Architecture

First Embodiment

The ballast driver IC of the first embodiment of the invention, identified by reference numeral 30 in FIG. 1, may be housed in a 16-pin DIP or SOIC package, and has the following pinouts:

VCC—Logic and internal gate drive supply voltage. A 15.6V internal zener diode clamps the voltage between VCC and GND. The nominal rising and falling undervoltage lockout thresholds are TBD and TBD, respectively. When the IC is in the undervoltage lockout mode, the total quiescent current is typically less than 150 $\mu$A, reducing the power dissipation requirements for the high voltage startup resistor. VCC should be bypassed to GND as close to the IC terminals as possible with a low ESR/ESL capacitor. A rule of thumb for the value of this bypass capacitor is to keep its minimum value at least 2500 times the value of the total input capacitance (Ciss) of the power transistors being driven.

IREF—Reference current setting. External resistor sets internal current references for all programmable inputs of IC.

TPH—Pre-heat timing pin. Internal reference current charges an external capacitor up to a 4V threshold to define the pre-heat time.

IPH—Preheat current setting. Internal reference current through an external resistor sets reference for closed-loop peak pre-heat current regulation.

VCO—Voltage controlled oscillator input. External capacitor sets ignition ramp time and loop compensation for pre-heat current and lamp power regulation.

PLAMP—Lamp Power setting. Internal reference current through external resistor sets reference for closed-loop lamp power regulation.

EOL—End of Life Setting. Internal reference current through an external resistor sets maximum VCO frequency shutdown threshold corresponding to a maximum allowable increase in lamp voltage during end-of-life. As the lamp voltage increases with lifetime, the regulation loop increases the frequency to hold a constant power in the lamp until the maximum setting is exceeded and the half-bridge circuitry is disabled.

COM IC—Power and Signal Ground. Both the low power control circuitry and low side gate driver output stage grounds return to this pin. The COM pin should be connected to the source of the low side power MOSFET using a single, separate board trace, to avoid the possibility of high current ground loops interfering with sensitive timing component currents. In addition, the ground return path of the timing components and VCC decoupling capacitor should be directly to the IC COM pin, and not via separate traces or jumpers to other ground traces on the board.

VB—High side gate drive floating supply. This is the power supply pin for the high-side level-shifting and gate driver logic circuitry. Power is normally supplied to the high-side circuitry by means of a simple charge pump from VCC. A high voltage, fast recovery diode (the so-called bootstrap diode) is connected between VCC (anode) and VB (cathode), and a capacitor (the so-called bootstrap capacitor) is connected between the VB and VS pins. When the low side power MOSFET or IGBT is on, the bootstrap capacitor is charged from the VCC-to-COM decoupling capacitor, by means of the bootstrap diode. When the high-side power MOSFET or IGBT is turned on, the bootstrap diode is reverse-biased, and the VB node floats above the source potential of the high-side power MOSFET or IGBT. VB should be bypassed to VS as close as possible to the IC pins with a low ESR/ESL capacitor. A rule of thumb for the value of this capacitor is to keep its minimum value at least 50 times the value of the total input capacitance (Ciss) of the power transistors being driven.

HO—High Side Gate Driver Output. This pin is connected to the gate of the high-side power MOSFET or IGBT. If high dV/dt conditions present at the output of the half-bridge cause the power transistor Miller currents (i.e., gate-to-drain currents) to exceed 0.5 A, it is recommended that gate resistors be used to buffer the IC from the power stage.

VS—High voltage floating supply return. The high-side gate driver and logic circuitry returns to this pin. The VS pin should be connected directly to the source of the high-side power MOSFET or IGBT. In addition, the half-bridge output transistors should be placed as close together as possible, in order to minimize series inductance between them.

LO—Low-Side Gate Driver Output. This pin is connected to the gate of the low-side power MOSFET or IGBT. If high dV/dt conditions present at the output of the half-bridge cause the power transistor Miller currents (i.e., gate-to-drain currents) to exceed 0.5 A, it is recommended that gate resistors be used to buffer the IC from the power stage.

CS1—Universal current sense input. Detects voltage produced by load current flowing through external sense resistor which is positive during on-time of either HO or LO gate drive outputs. Also includes a comparator with a lower threshold for detecting lamp presence and an upper threshold for sensing current limit. Also performs current sensing for pre-heat current regulation and for lamp power regulation.

CS2—Secondary current sense input. Detects voltage produced by load current flowing through external sense resistor which is positive during on-time of HO gate drive output. Includes a window comparator with a low threshold for detecting lamp presence and an upper threshold for detecting current limit.

CS3—Third current sense input. Detects voltage produced by load current flowing through external sense resistor which is positive during on-time of HO gate drive output. Includes a window comparator with a lower threshold for detecting lamp presence and an upper threshold for current limit.

SD—Shutdown Pin. This pin is used to disable the half-bridge driver circuitry, turning both of the gate driver outputs HO and LO off (active low), and putting the ballast IC controller into the micropower mode. The rising shutdown pin threshold voltage is 2.5V, and approximately 0.1V of hysteresis has been included to increase noise immunity. The shutdown function is not latched, and the output of the SD comparator resets the CS latch, so that when the SD pin voltage is brought back below its input threshold the IC reinitiates the preheat sequence.

Figure 3:
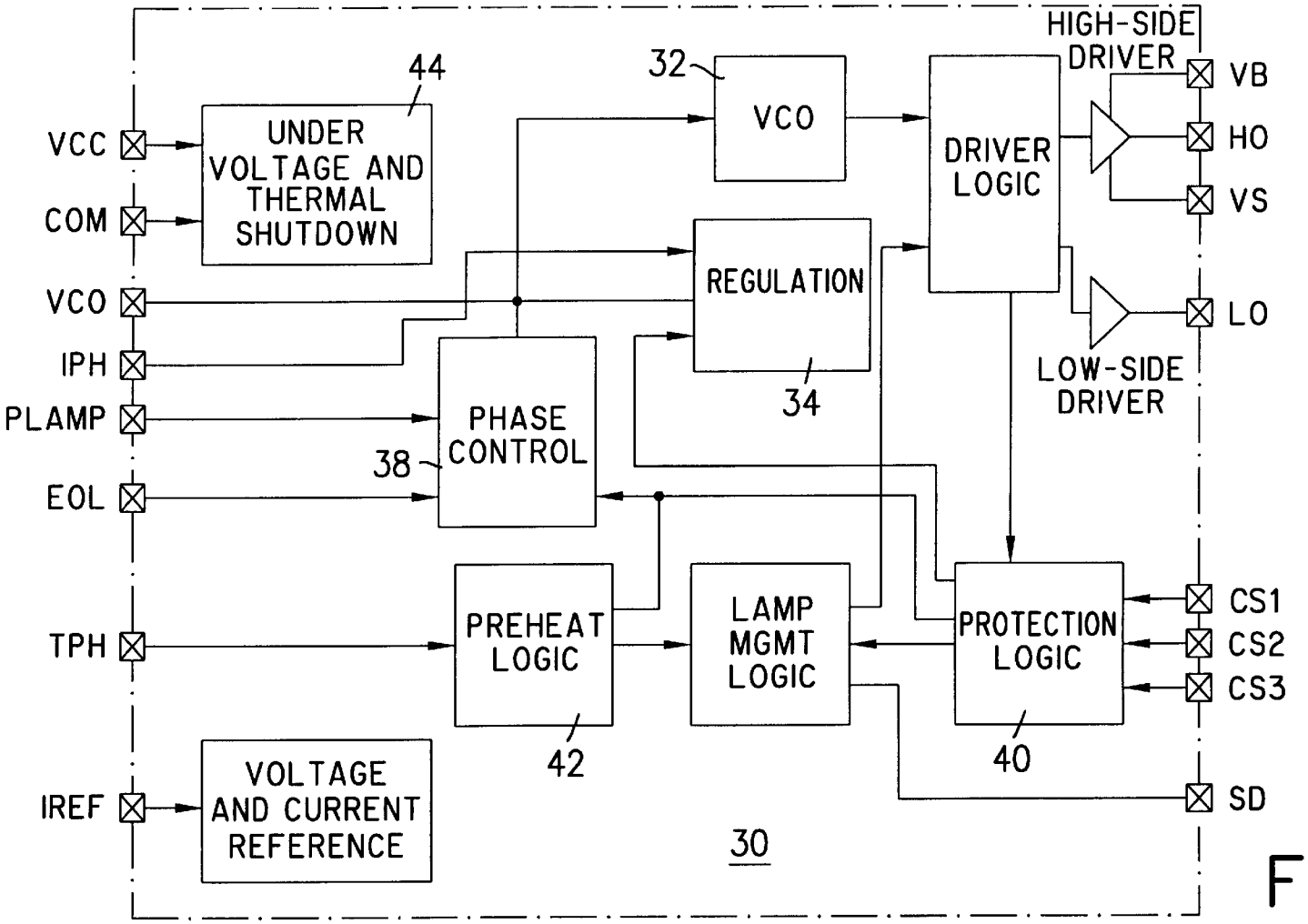
FIG. 3 is a block diagram of the first embodiment of the present invention.
Figure 4:
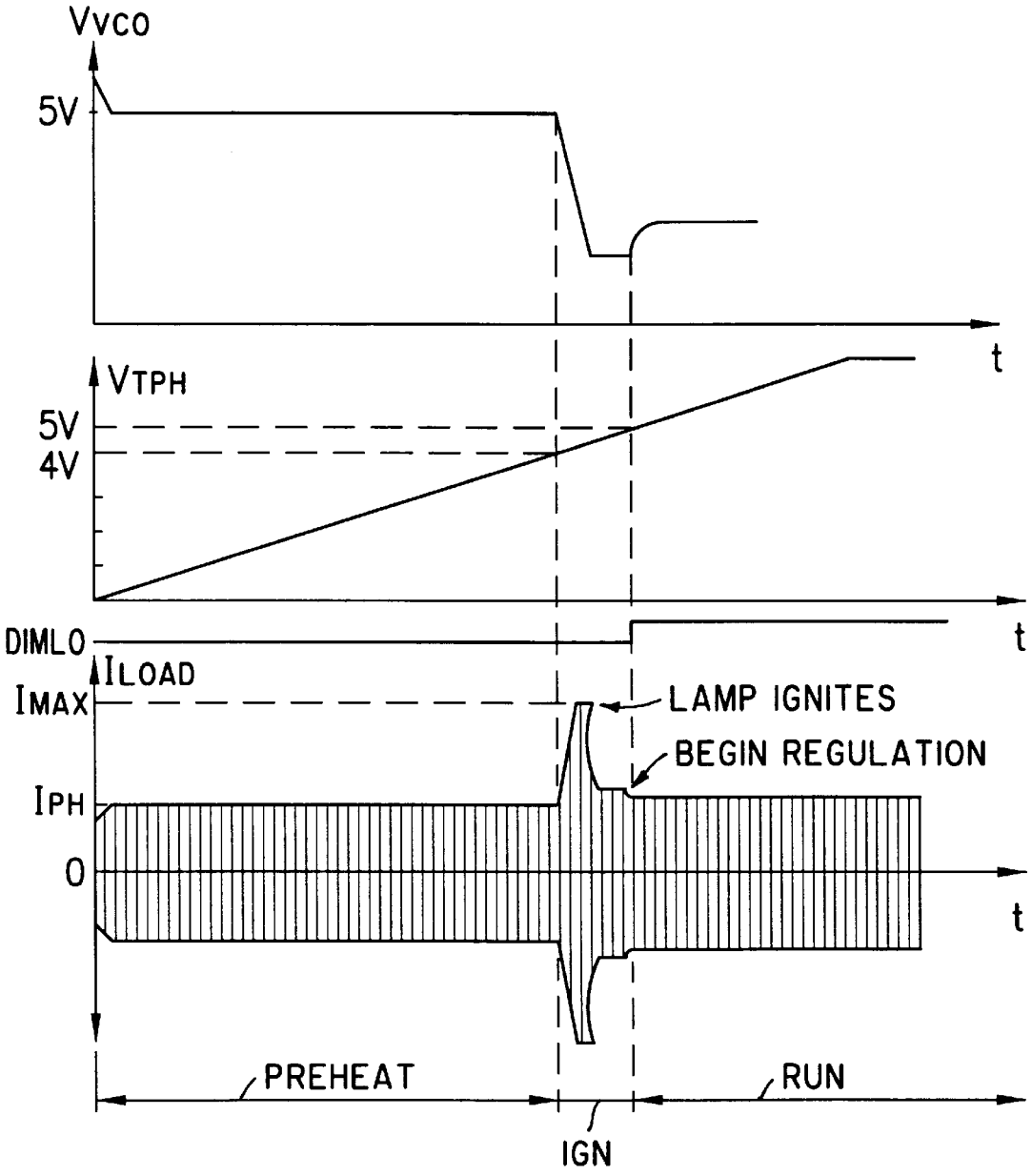
FIG. 4 are timing diagrams showing the voltage on the VCO pin, the voltage on the TPH pin and the envelope of load current during normal pre-heat, ignition and running conditions for the first embodiment of the present invention.

Referring now to FIG. 3, a block diagram of the overall architecture of ballast IC 30 is shown. In operation, a voltage-controlled oscillator (VCO) 32 sets the operating frequency of the half-bridge driver. The voltage at the input of VCO 32 is adjusted by the "REGULATION" block 34, which sources or sinks current into a capacitor (not shown) at the input of VCO 32, depending on the error between a reference phase and the phase of the inductor current of one of the resonant lamp output stages. The inductor current is sensed by a voltage at one of the current-sensing inputs (CS1, CS2 or CS3) which is produced by inserting a sensing resistor (RCS) 36 between the lamp filament and ground (as shown in the typical connection diagram of FIG. 2) and/or between the source of the lower half-bridge MOSFET 21 and ground. The zero-crossing of this voltage determines the phase, which is fed back to the PHASE CONTROL block 38 where it is subtracted from the reference phase to produce an ERROR pulse for regulation.

Figure 5:
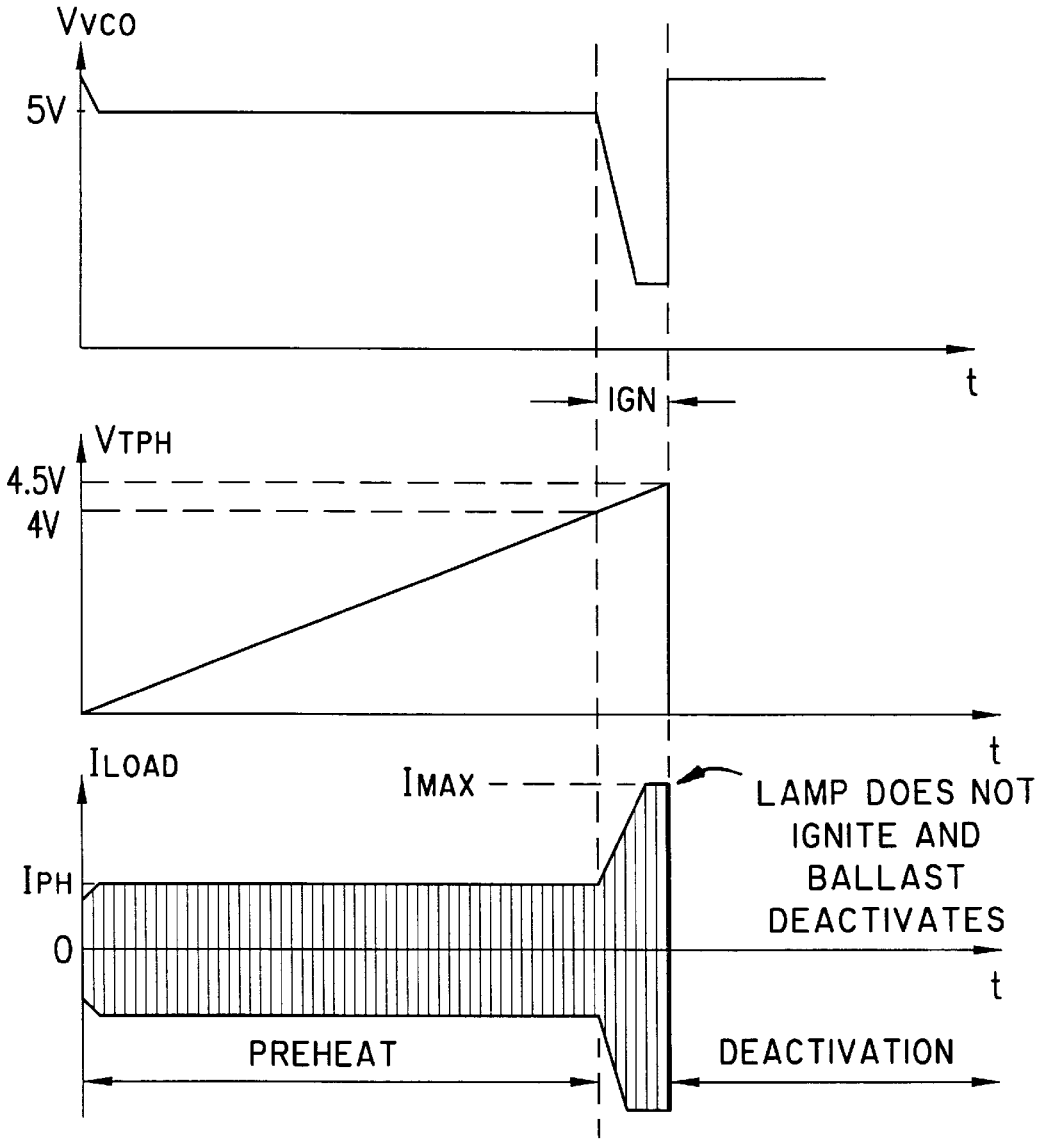
FIG. 5 are timing waveforms showing the voltage on the VCO pin, the voltage on the TPH pin and the envelope of load current during a non-strike condition for the first embodiment of the present invention.

During pre-heat (see the timing diagram of FIG. 3, showing normal preheat, ignition and running conditions), the REGULATION block 34 is used to regulate the peak, cycle-by-cycle load current against a programmable pre-heat current reference input, IPH. Preheat logic is included in block 40—the pre-heat time is determined by a linear ramping voltage produced by an internal current charging an external capacitor on pin TPH. If the lamp does not strike, the ballast deactivates as shown in the timing diagram of FIG. 5.

Lamp power is set by a voltage produced by an internal current flowing through an external resistor at pin PLAMP, which sets the reference phase for phase control block 38. An internal current through an external resistor at pin EOL produces a voltage which, when compared with the VCO voltage, programs a maximum frequency shutdown. If end-of-life occurs in one or more of the lamps as detected by protection logic 40, phase control 38 causes the frequency to increase in an attempt to keep the power constant until the maximum frequency, FMAX, is reached and the ballast is safely shut down.

The shutdown pin, SD, provides a logic input external shutdown option. If this pin is pulled above 2 volts, the ballast is held off in an 'un-latched' state. When pulled back below 2 volts again, the preheat sequence is reset via preheat logic 42, and the ballast starts again. This allows for automatic restarting of the ballast after a fault condition has occurred by removing and inserting a lamp without recycling the input mains voltage to the ballast.

Figure 6A:
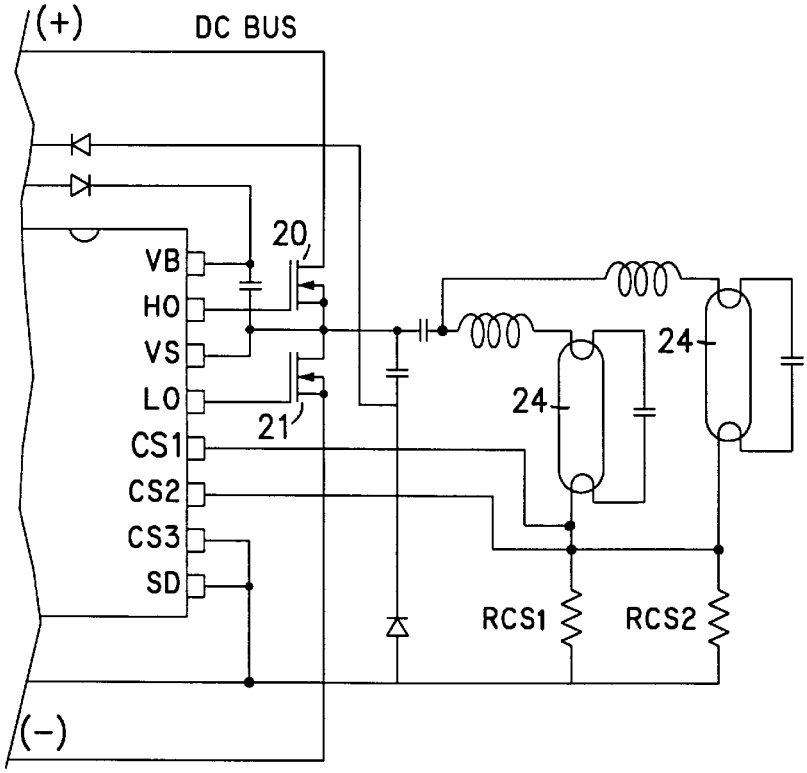
FIG. 6A–6D are multiple lamp hook-up configurations for the first embodiment of the present invention.
Figure 6B:
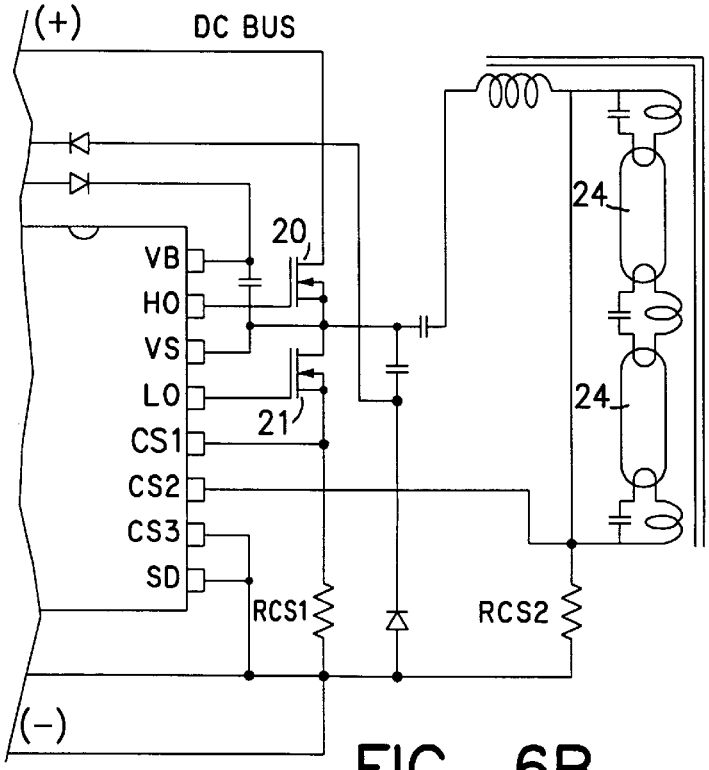
Figure 6C:
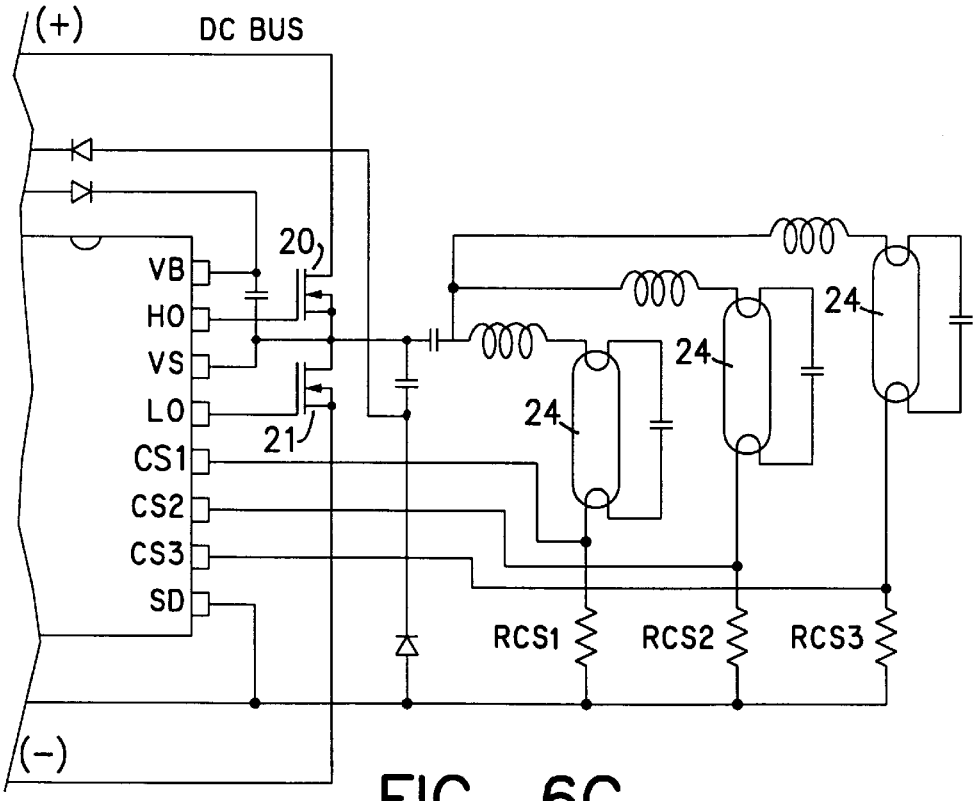
Figure 6D:
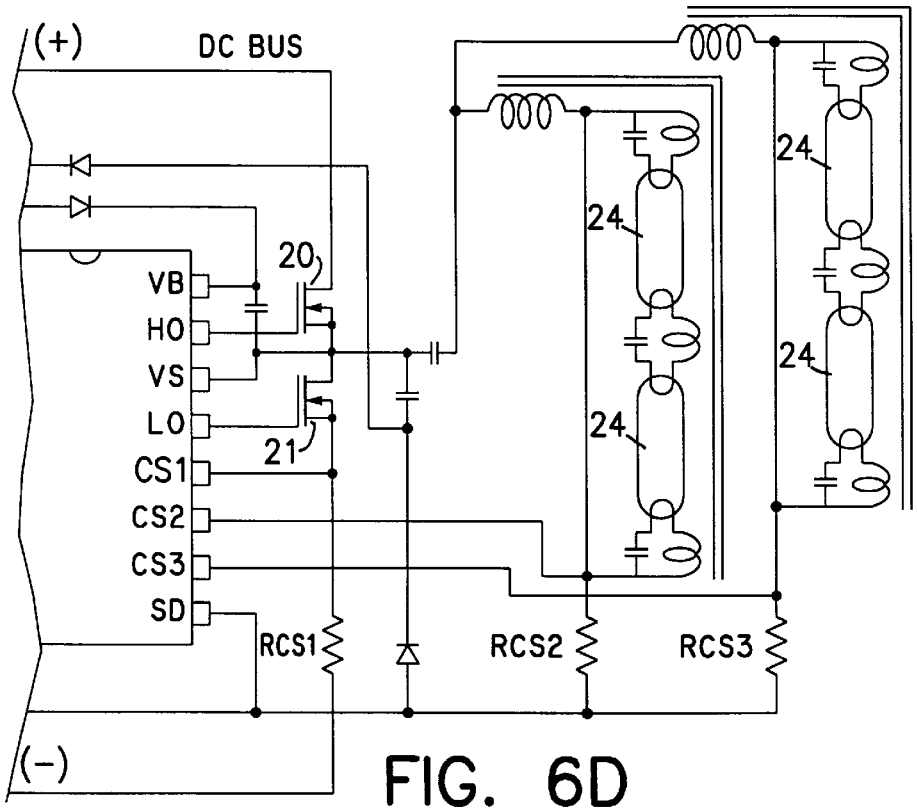

FIGS. 6A–6D show various multiple lamp configurations for the ballast controller IC of the first embodiment of the invention—FIG. 6A shows a dual parallel configuration; FIG. 6B shows a dual series configuration; FIG. 6C shows a triple parallel configuration; and FIG. 6D shows a series-parallel configuration. Note that the sense resistor(s) RCS1–RCS3 for multiple lamp configurations are disposed between the lamp cathodes and ground; similarly, RCS 36 in FIG. 1, a single lamp configuration, could be inserted in this alternative position.

In a multiple lamp configuration, if one lamp is removed or a filament opens, the other lamps will continue to operate. If the lamp is replaced and reinserted during running, the ballast is shut down and the pre-heat sequence is reset and all lamps are pre-heated and ignited again.

The ballast controller IC of the present invention also includes, as depicted in circuit block 44, micro-power start-up, zener clamped VCC, over-temperature shutdown and under-voltage lockout. The under-voltage lockout (UVLO) provides turn-on and turn-off thresholds with hysteresis for noise and off-line supply.

Overall Architecture

Second Embodiment

The overall architecture of the second embodiment of the ballast IC controller of the present invention differs from that of the first embodiment in that it is specifically designed for professional dimming down to ultra-low light levels.

The chip of the second embodiment, shown in FIG. 2 and identified by reference numeral 50, has many of the same pinouts as the first embodiment, with the following exceptions relating to the dimming function:

VCO—Voltage controlled oscillator input. External capacitor sets not only ignition ramp time and loop compensation for pre-heat current regulation, but also phase control for dimming.

DIM—Dimming control input. 0–5VDC external control voltage corresponding to lamp power setting.

MAX—Maximum lamp power. Internal reference current through external resistor sets maximum lamp power corresponding to 5VDC dimming control input voltage.

MIN—Minimum lamp power. Internal reference current through external resistor sets minimum lamp power corresponding to OVDC dimming control input voltage.

CS—Current sense input. Detects the voltage produced by load current flowing through external sense resistor which is positive during on-time of LO gate drive output. Includes a comparator with upper threshold for current limit. Also performs current sensing for pre-heat current regulation and for phase control (dimming).

FB—Loop compensation. External compensation network for stable feedback loop during dimming. The resistor between pin FB and pin VCO has a value of between 500 Ω–10 KΩ.

Figure 7:
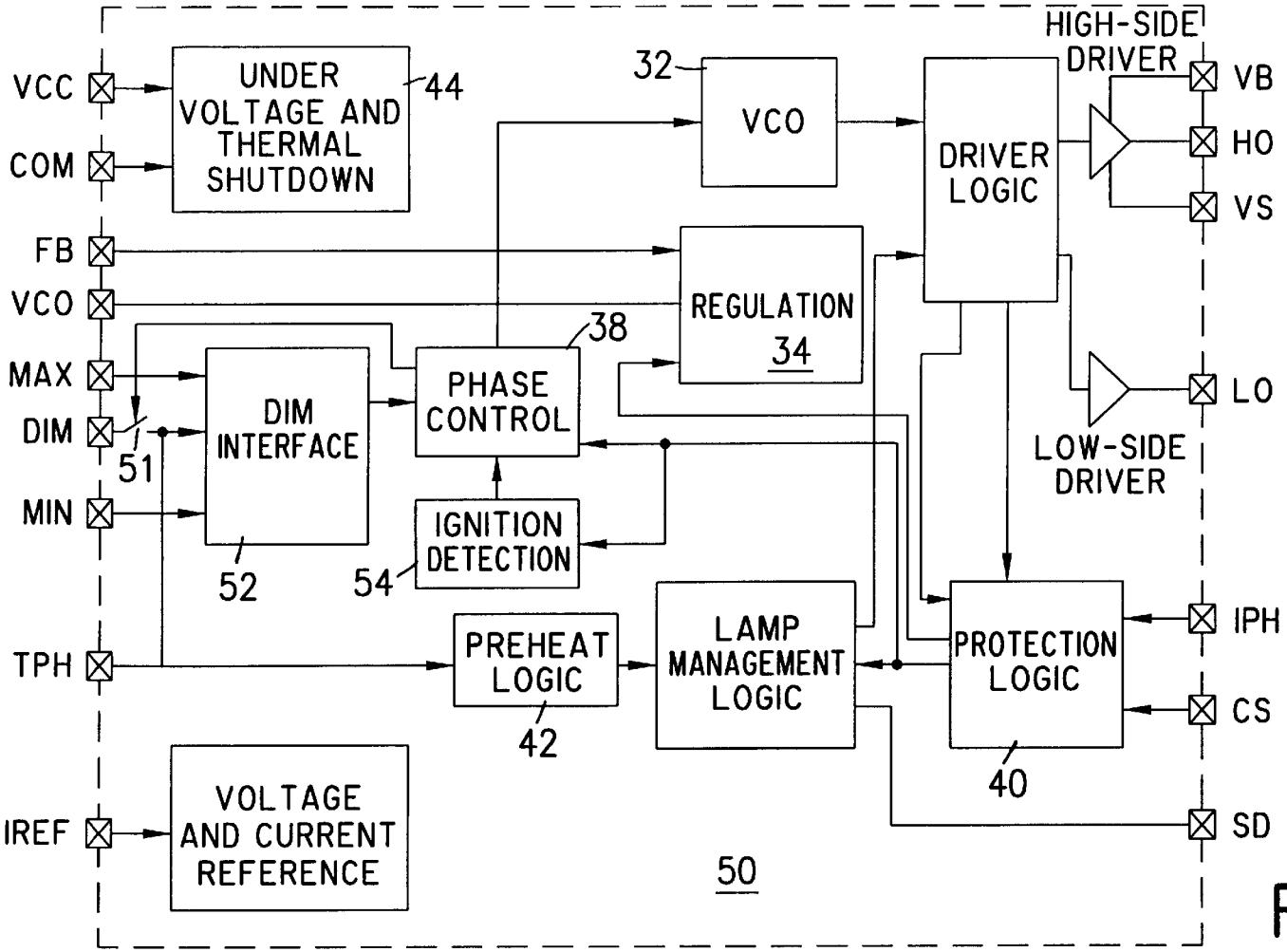
FIG. 7 is a block diagram of the second embodiment of the present invention.

Referring now to the block diagram of the second embodiment of the invention shown in FIG. 7, a DIMMING INTERFACE 52 is provided which allows 0–5VDC analog control of lamp brightness, with minimum and maximum adjustments. In order to simulate lamp ignition at any brightness setting, an IGNITION DETECTION block 54 detects a change in the phase of the inductor current (as measured in the source of the lower half-bridge MOSFET at PIN CS) indicative of a lamp ignition. This tells the REGULATION block 34 that the lamp has successfully ignited and to close-the-loop and regulate the phase of the inductor current against the reference phase generated by the DIM INTERFACE 52.

Because of the ionization time constant of the lamp (~1 ms), the lamp cannot respond as fast as the loop, which can result in an overshoot of the VCO voltage causing the lamp to extinguish immediately after ignition. To prevent this, an internal switch S1 is provided to connect the DIM input to the TPH pin, which ramps up to between 4 and 5 volts during ignition.

Figure 8:
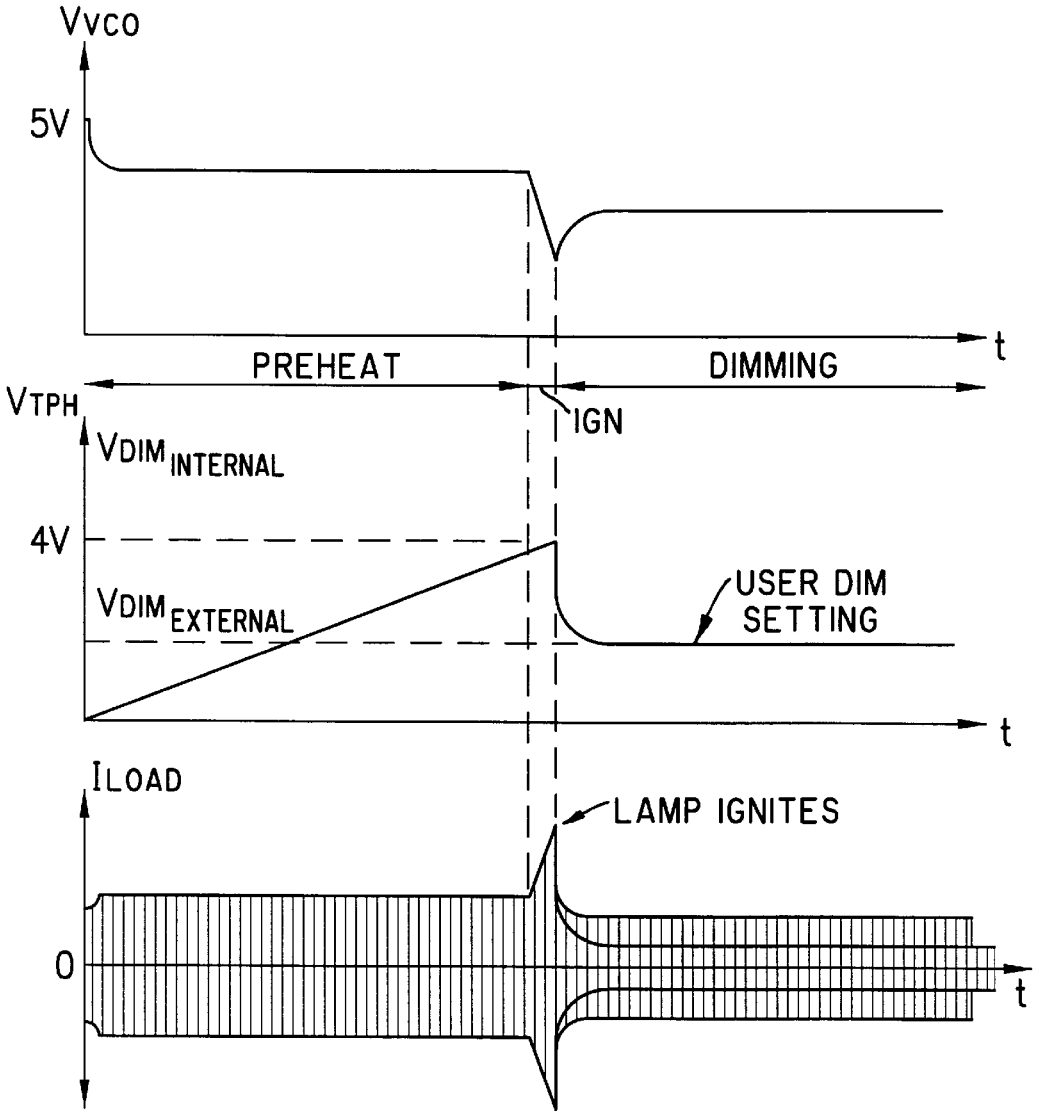
FIG. 8 are timing diagrams showing the voltage on the VCO pin, the voltage on the TPH pin and the envelope of load current during normal pre-heat, ignition and dimming conditions for the second embodiment of the present invention.
Figure 9:
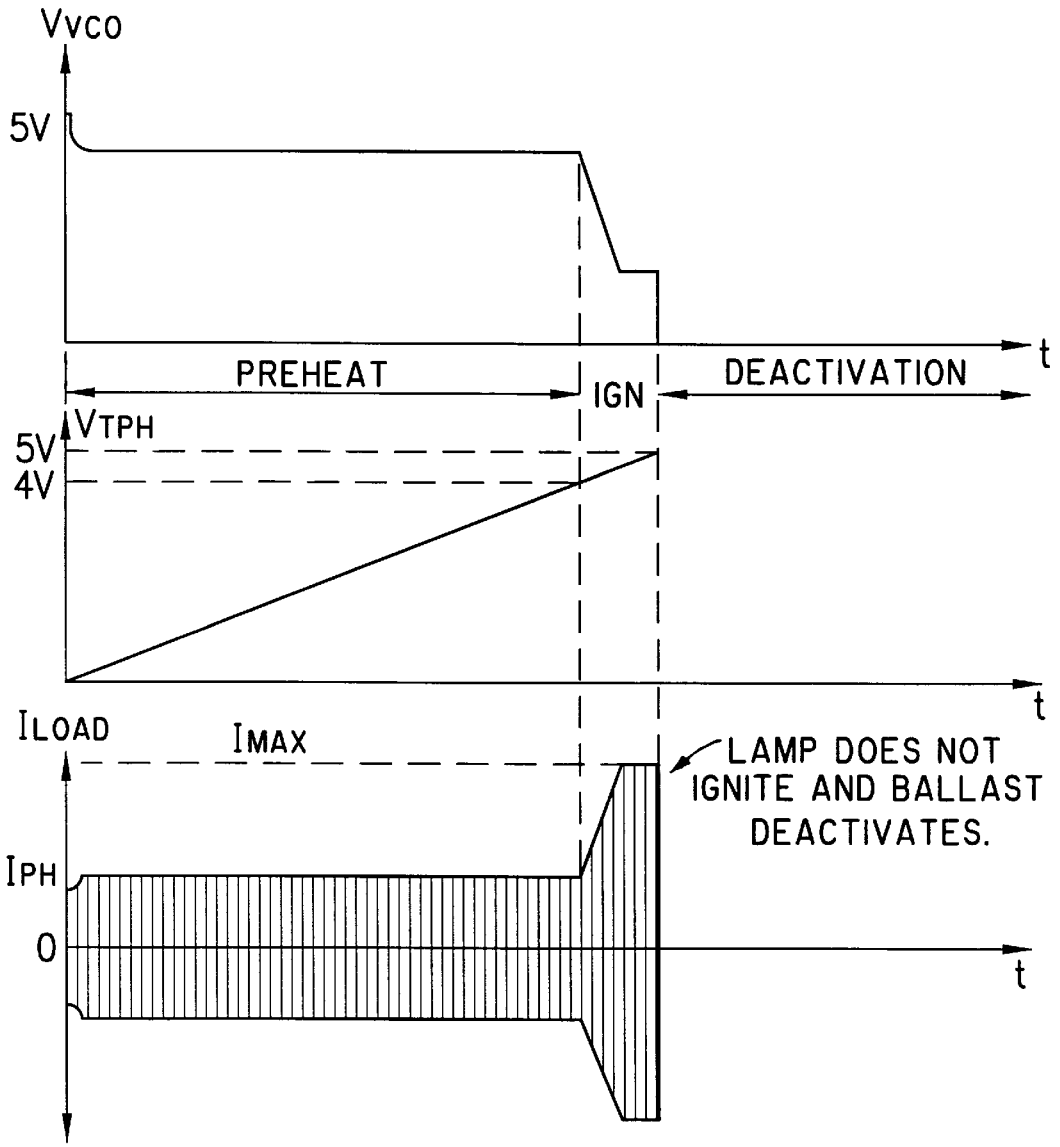
FIG. 9 are timing waveforms showing the voltage on the VCO pin, the voltage on the TPH pin and the envelope of load current during a non-strike condition for the second embodiment of the present invention.

More specifically, with reference to the typical connection diagram of FIG. 2 and the timing diagrams of FIGS. 8–9 (showing normal operation and operation where the lamp fails to strike, respectively), capacitor 58, connected to pin TPH, charges up through an internal current source during preheat. When the voltage on capacitor 58 reaches the 4V internal threshold, preheat is over. With continuing reference to FIG. 8, capacitor 58 continues to charges past 4V, the lamp ignites, and the ignition detection block 54 detects ignition. At this point, the circuitry of the chip closes switch S1 (FIG. 7) and the voltage on the DIM pin discharges to the voltage set by the user at an exponential rate determined by values of capacitor 58 and resistor 56. The time constant formed with capacitor 58 and resistor 56 is therefore programmable, allowing the designer to adjust the "travel" time from ignition to the dim setting for different lamp types. Capacitor 58 typically has a maximum value of 1 $\mu$F and resistor 56 has a typical value between 1 K–100 KΩ, depending on the desired travel time.

A detailed description of the significant circuit blocks shown in the block diagrams of FIGS. 3 and 7 is now provided.

1. Over-Current Protection Circuit

In an electronic ballast lamp resonant output stage, it is necessary to have some form of current limit to prevent excessive and dangerous high voltages from appearing over the fluorescent lamp. The high voltages can result from attempting to strike a deactivated lamp (cathodes intact but no gas or broken tube). These voltages and associated currents are harmful to the person touching the fluorescent lamp while removing or inserting a lamp from the fixture lamp sockets, and can also exceed the absolute maximum voltage and current ratings of power components comprising the lamp resonant output stage of the ballast.

Both embodiments of the invention have over-current protection defined by an internal threshold generated within protection logic block 40. The protection compares an internal threshold with the voltage developed across a low-ohmic external current sensing resistor RCS through pin CS (pins CS1, CS2 and CS3 in the first embodiment). External current sensing resistor RCS is disposed between the lower half-bridge switch and ground (as shown, for example in FIGS. 1 and 2) or disposed between the lower lamp filament and ground (as shown, for example, in FIGS. 6A and 6C).

If the voltage across sensing resistor RCS exceeds the internal threshold, the peak output current is first regulated or limited to the threshold by injecting current pulses to the VCO capacitor via a signal to Phase Control 38 each time the threshold is exceeded. (Note that the direction in which the VCO is designed to operate is arbitrary—i.e., the circuit could be designed such that the VCO capacitor is sinked by current pulses, rather than charged.) This continues until pin TPH voltage charges up to 5V, allowing the lamp to strike. The next time the threshold is exceeded, the ballast IC is latched off and the half-bridge switches are tri-stated, shutting the ballast down.

A cycling of the SD pin or the voltage on VCC will reset the IC and start the pre-heat sequence again. During running or dimming, the over-current threshold can be used to detect non-zero voltage at the half-bridge, which can occur when the lamp is removed, as described in greater detail in the following section on the lamp presence detection circuit.

Figure 10:
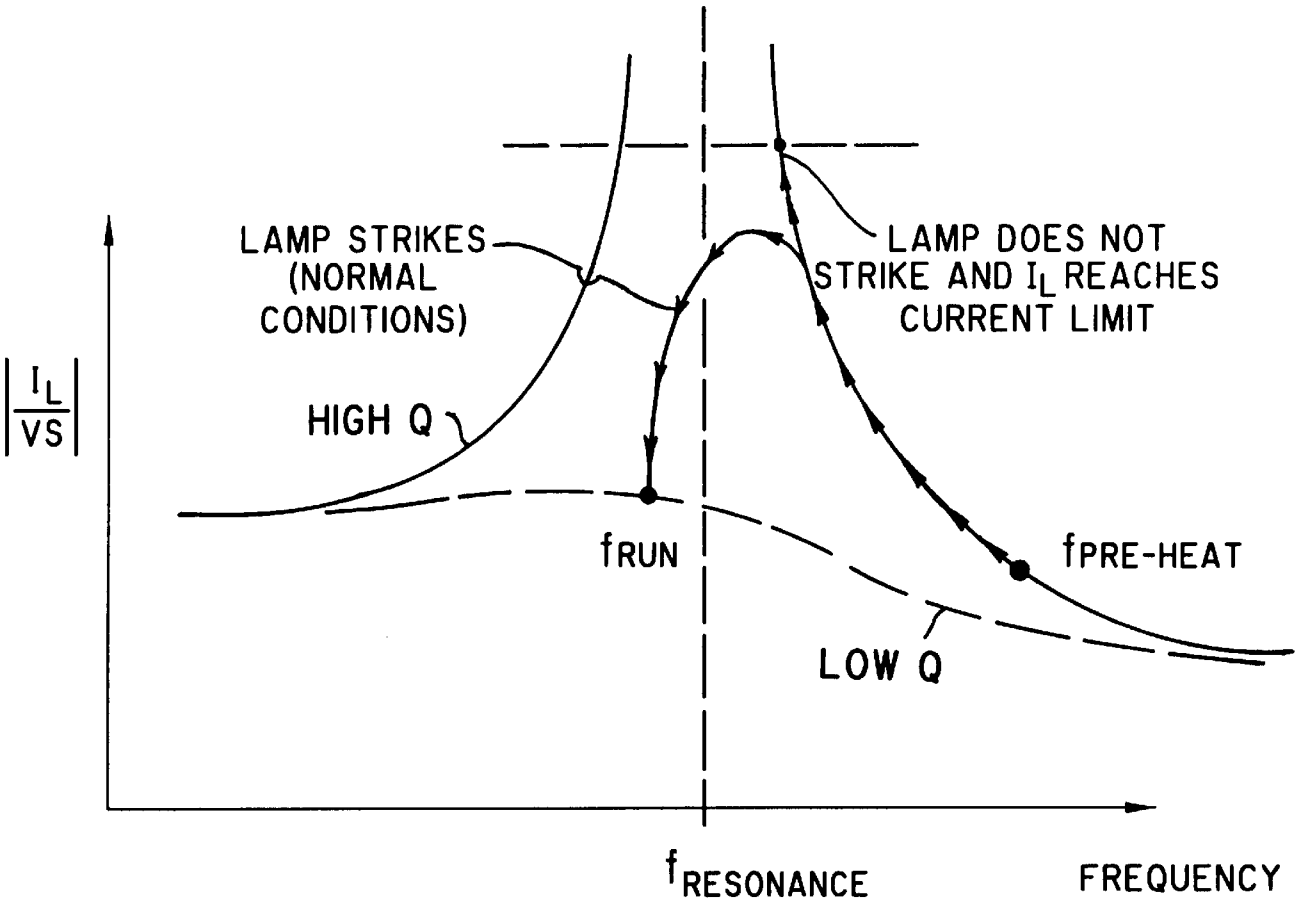
FIG. 10 is a Bode Diagram of the transfer function of the ballast output stage during preheat, ignition and running operating conditions.
Figure 11:
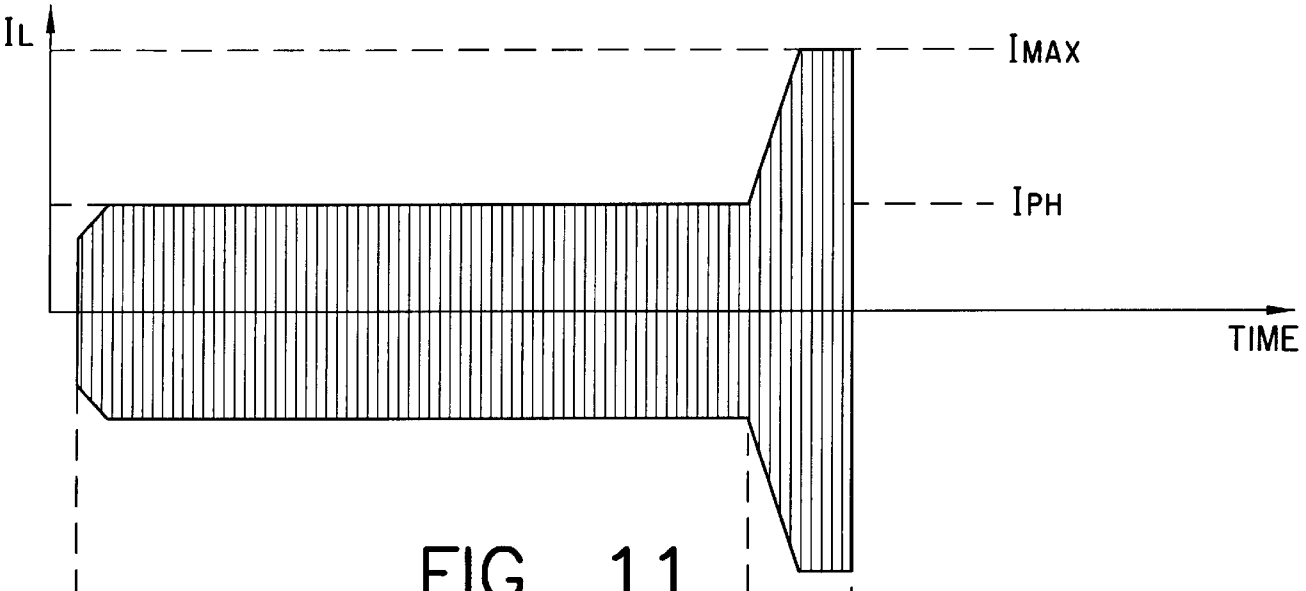
FIG. 11 shows the load current ($I_L$) during a lamp non-strike occurrence.
Figure 12:
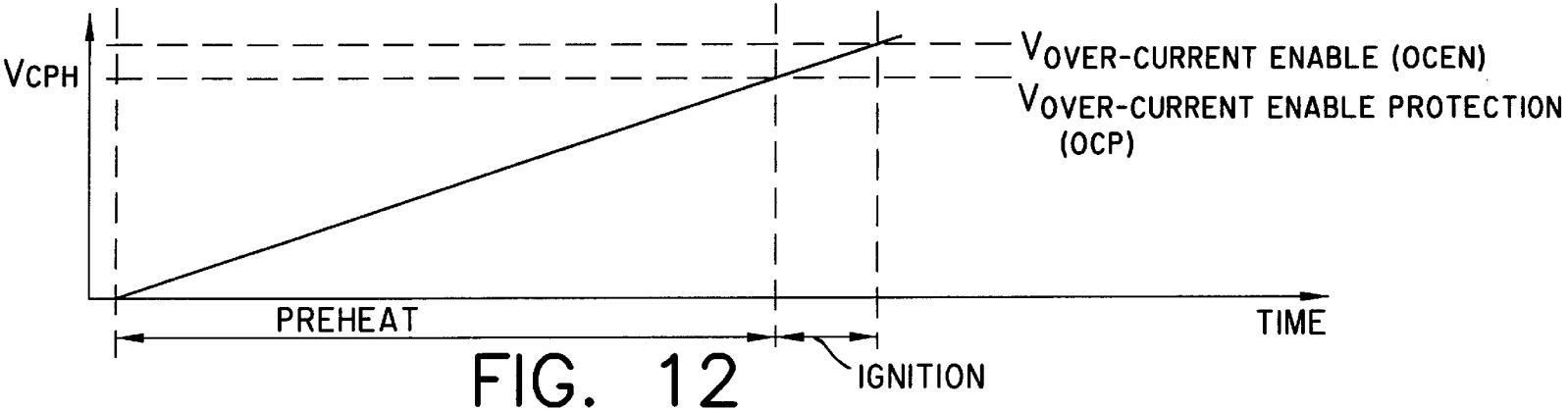
FIG. 12 is a timing diagram during pre-heat of the control circuit of the present invention.
Figure 13:
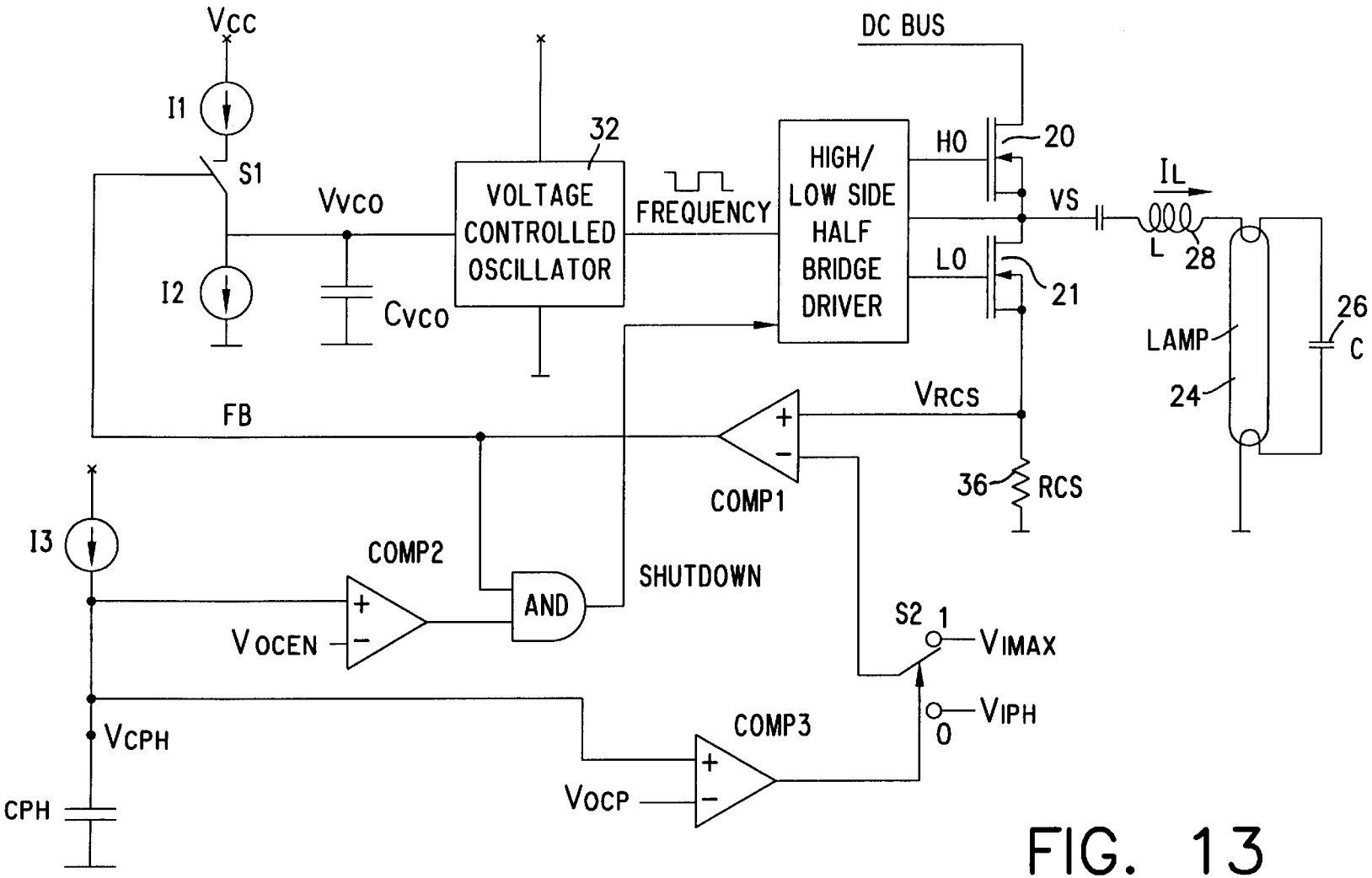
FIG. 13 shows the closed loop over-current control circuit of the present invention.

The overcurrent protection circuit of the present invention, which is responsible for sensing the current, regulating the current against a reference threshold and tri-stating the half-bridge switches, is shown in FIG. 13, with the corresponding timing diagram shown in FIG. 12 aligned with appropriate load current in FIG. 11. The Bode diagram of the transfer function of the resonant output stage (FIG. 10) shows the operating points of the ballast, together with the current limit. As shown in FIG. 10, the current is limited at the threshold for a fixed time before the half-bridge switches are tri-stated (both off). Maintaining the current for some time before the ballast is shutdown will give the lamp time to ignite.

With reference again to FIG. 13, the overcurrent protection circuit will now be described in detail. The circuit compares a voltage proportional to the total load current across RCS with a fixed threshold $V_{IMAX}$. Should $V_{RCS}$ exceed $V_{IMAX}$, the output of COMP1 (FB) goes high and sends a pulse to switch S1. This causes S1 to close, allowing current to charge from current source I1 into capacitor $C_{VCO}$. The voltage on $C_{VCO}$ therefore increases, causing the output frequency of the half-bridge signal driving the lamp resonant stage (VS) to also increase. This moves the operating point along the High-Q transfer function (FIG. 10) to the right, decreasing the total load current below the maximum limit.

Once switch S1 opens again, current source I2 discharges $C_{VCO}$ causing the frequency to decrease and the load current (I1) to increase again until the limit is exceeded again. This "nudging" effect, which limits the current, continues until the voltage on CPH ($V_{CPH}$) reaches the threshold $V_{OCEN}$ and the output of COMP2 (TRI-STATE) goes high and the Half-Bridge Driver is disabled and half-bridge transistor switches 20 and 21 are tri-stated (both off).

Figure 14:
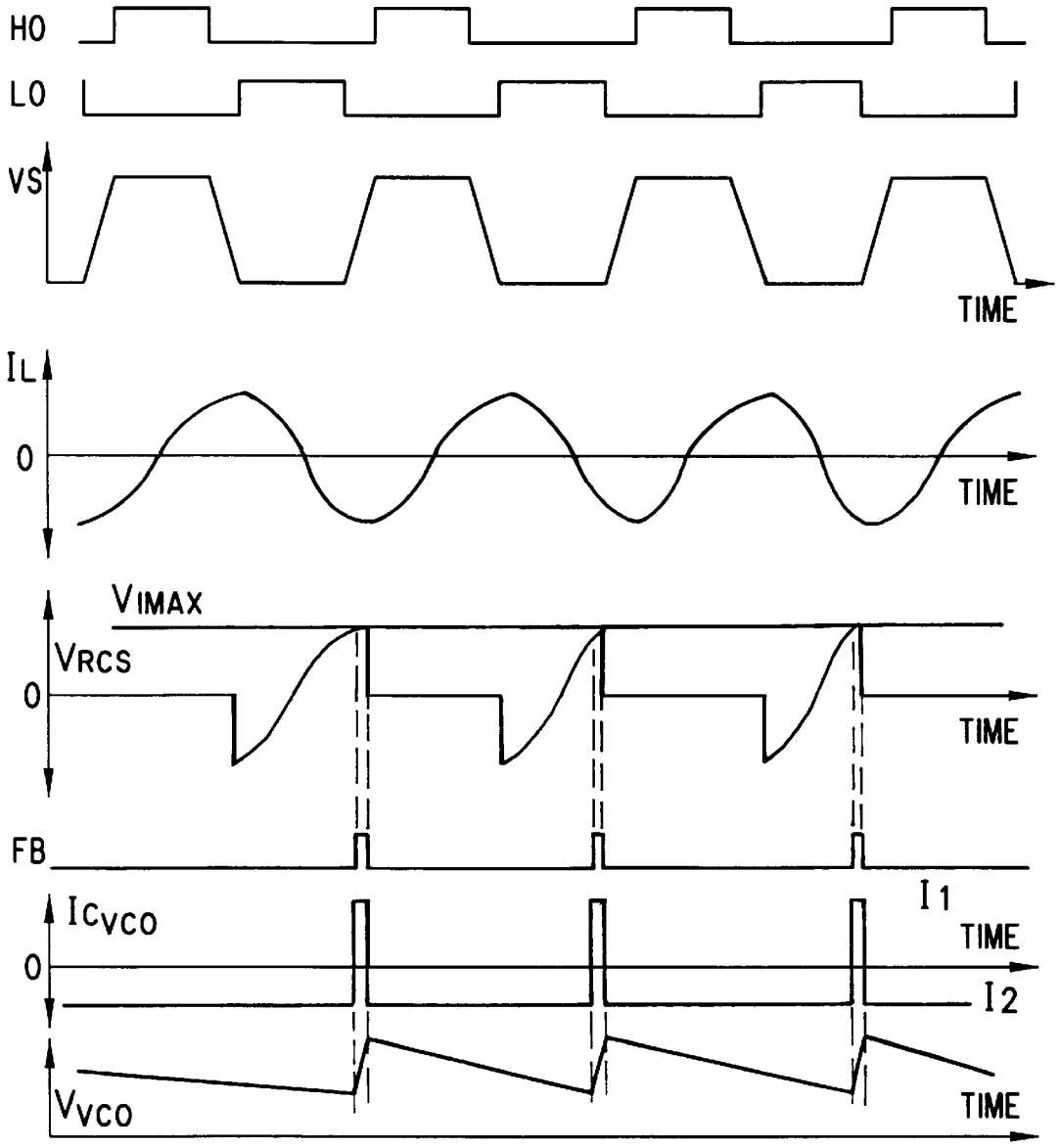
FIG. 14 is a timing diagram of the over-current control circuit of the present invention.

The same circuit is used for regulating the peak pre-heat current flowing through the lamp filaments. The peak current reference threshold is initially connected to $V_{IPH}$ (FIG. 13) via switch S2 and regulates the total peak load current to this value until the voltage on capacitor CPH exceeds threshold voltage $V_{OCP}$. At this time, the pre-heat period has ended (see FIGS. 11 and 12) and the output of comparator COMP3 drives switch S2 to the "high" position (as denoted by a "1" on S2), shifting the regulation threshold to the higher value $V_{IMAX}$. Current source I2 discharges capacitor $C_{VCO}$ linearly, causing the frequency to ramp down towards the resonance frequency of the High-Q resonant output stage (FIG. 10) until either the lamp strikes successfully, or, $V_{IMAX}$ is reached. FIG. 14 is a timing diagram of the over-current control circuit of FIG. 13.

The first embodiment of the invention includes not only an upper threshold, but also a lower threshold of 200mV which is used to detect near or below resonance operation and lamp insertion during running.

2. Lamp Presence Detection Circuit

Both embodiments of the invention include lamp presence detection circuitry to detect: (1) if a fluorescent lamp (or lamps) have been inserted into the lamp resonant circuit before starting up; and (2) if a fluorescent lamp is removed during ballast operation. This circuitry avoids damage to the ballast, specifically to MOSFETs/IGBTs 20 and 21, which can occur if ballast continues to operate during a lamp out condition. The damage is caused by high currents resulting from the charging or discharging of snubber capacitor 60 (see FIGS. 1 and 2); in the absence of a lamp, there is no load current to commutate capacitor 60, and a non-zero voltage switching condition occurs over MOSFETs/IGBTs 20 and 21, which leads to the eventual thermal destruction of MOSFETs/IGBTs 20 and 21.

The lamp presence detection circuit of the present invention, contained within Protection Logic block 40, uses the same sense resistor RCS described above with respect to peak current detection, disposed in series with the source of the lower MOSFET/IGBT 21 of the half-bridge. The current flowing through resistor RCS is zero if the half-bridge is operating with no lamp inserted, except for the high current "spikes" which occur at the turn-on of MOSFET/IGBT 21.

Figure 15:
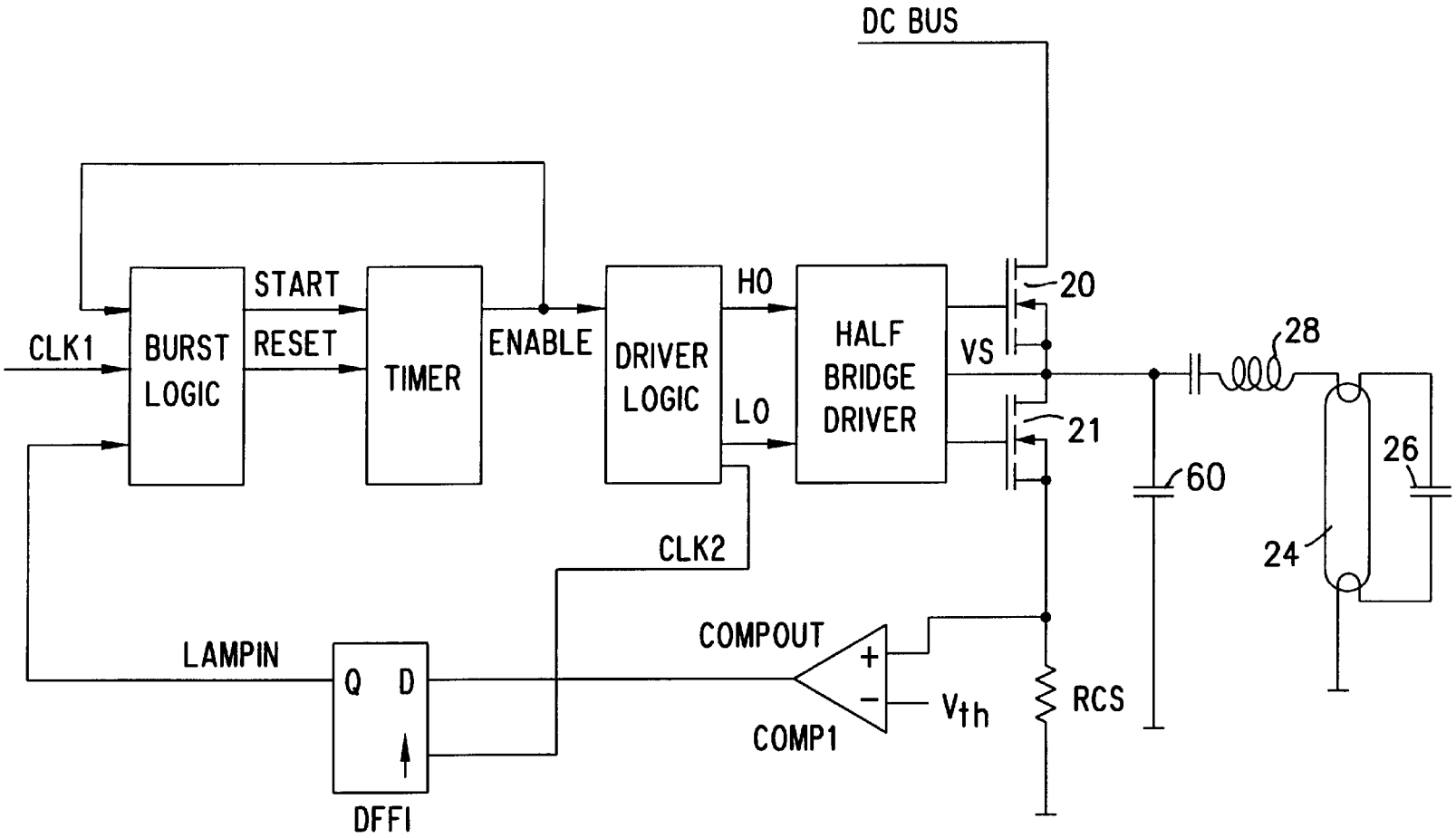
FIG. 15 is a block diagram of the lamp presence detection circuit of the present invention.
Figure 16:
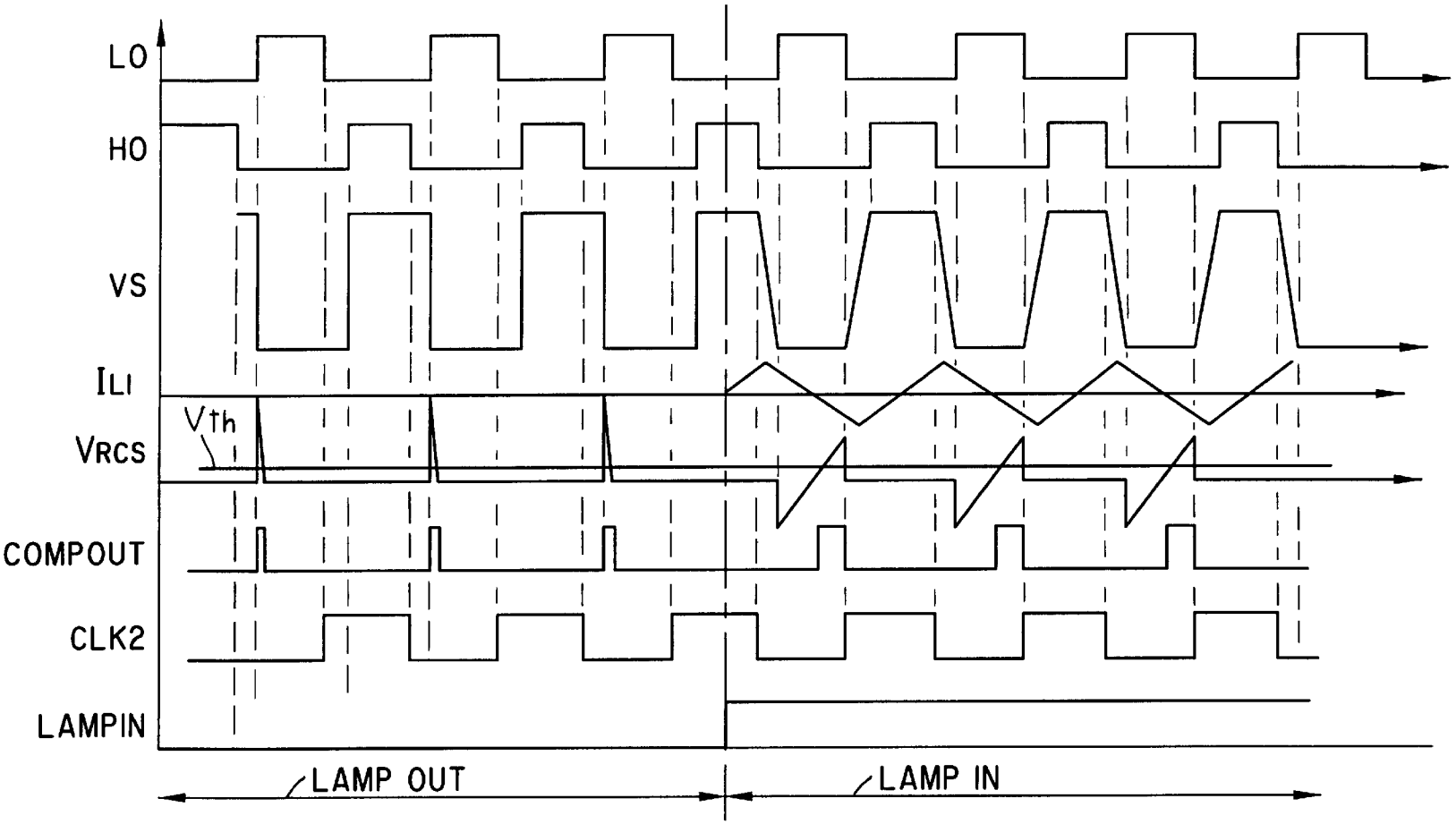
FIG. 16 are timing waveforms for the lamp presence detection circuit.

If a lamp is inserted while the half-bridge is operating, then a current flows through resistor RCS which is only present when MOSFET/IGBT 21 is on, which is a piece-wise-linear section of the total lamp circuit current ($I_{L1}$), and is 90° phase shifted from the total lamp circuit current ($I_{L1}$) (see FIG. 16). The resulting voltage across resistor RCS is compared with a d.c. threshold voltage "th" (COMP1) (FIG. 15) with the output being a digital 'high' if the voltage across RCS is greater than 'Vth' and a digital 'low' if the voltage across RCS is less than 'Vth'.

Due to the slow rising edge of the current being measured, it is possible for the comparator output to "chatter" as the voltage across resistor RCS begins to exceed "Vth". To avoid detection of this "chatter" or any other unwanted signals such as turn-on "spikes" or high frequency, high-current noise which can be present on the measuring point (voltage over RCS), the output of comparator COMP1 is synchronized with the turn-off edge of MOSFET/IGBT 21. This is accomplished with a D-Type Flip Flop (DFF1, FIG. 15) with the clock signal of the Flip Flop (CLK2) being a control signal of the driver logic whose positive-going edge generates the negative-going edge of the gate-to-source voltage of MOSFET/IGBT 21 (noted as signal 'LO', FIG. 16), denoting a turn-off of MOSFET/IGBT 21. In other words, a measurement is taken just before MOSFET/IGBT 21 is turned 'off'. A propagation delay from the CLK2 signal to the actual turn-off of MOSFET/IGBT 21 allows for the time needed for the D input of DFF1 (or output of COMP1) to be clocked, while remaining free of any possible turn-off disturbance.

Figure 17:
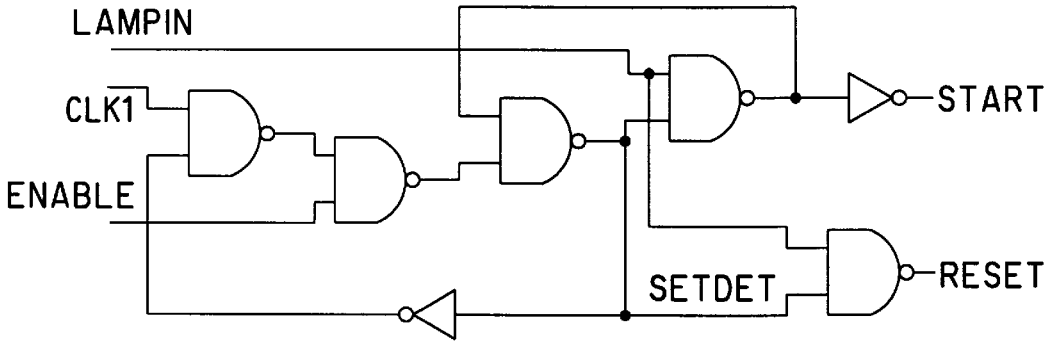
FIG. 17 is a circuit diagram and accompanying truth table for the burst logic of the lamp presence detection circuit.
Figure 18:
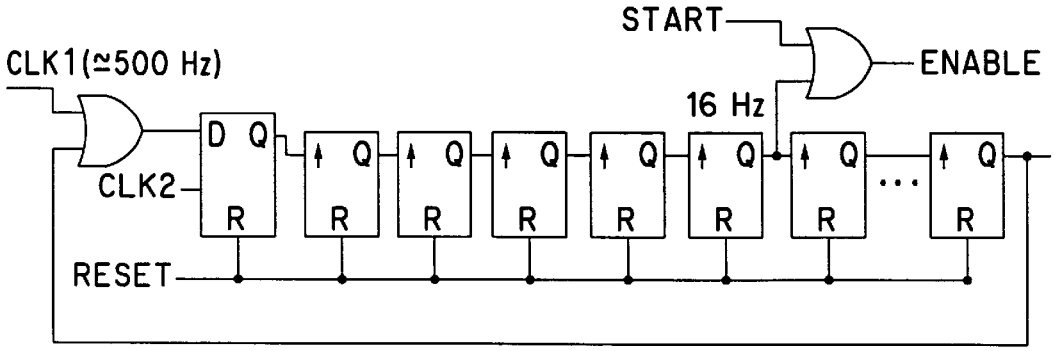
FIG. 18 shows the timer circuit of the lamp presence detection circuit.
Figure 19:
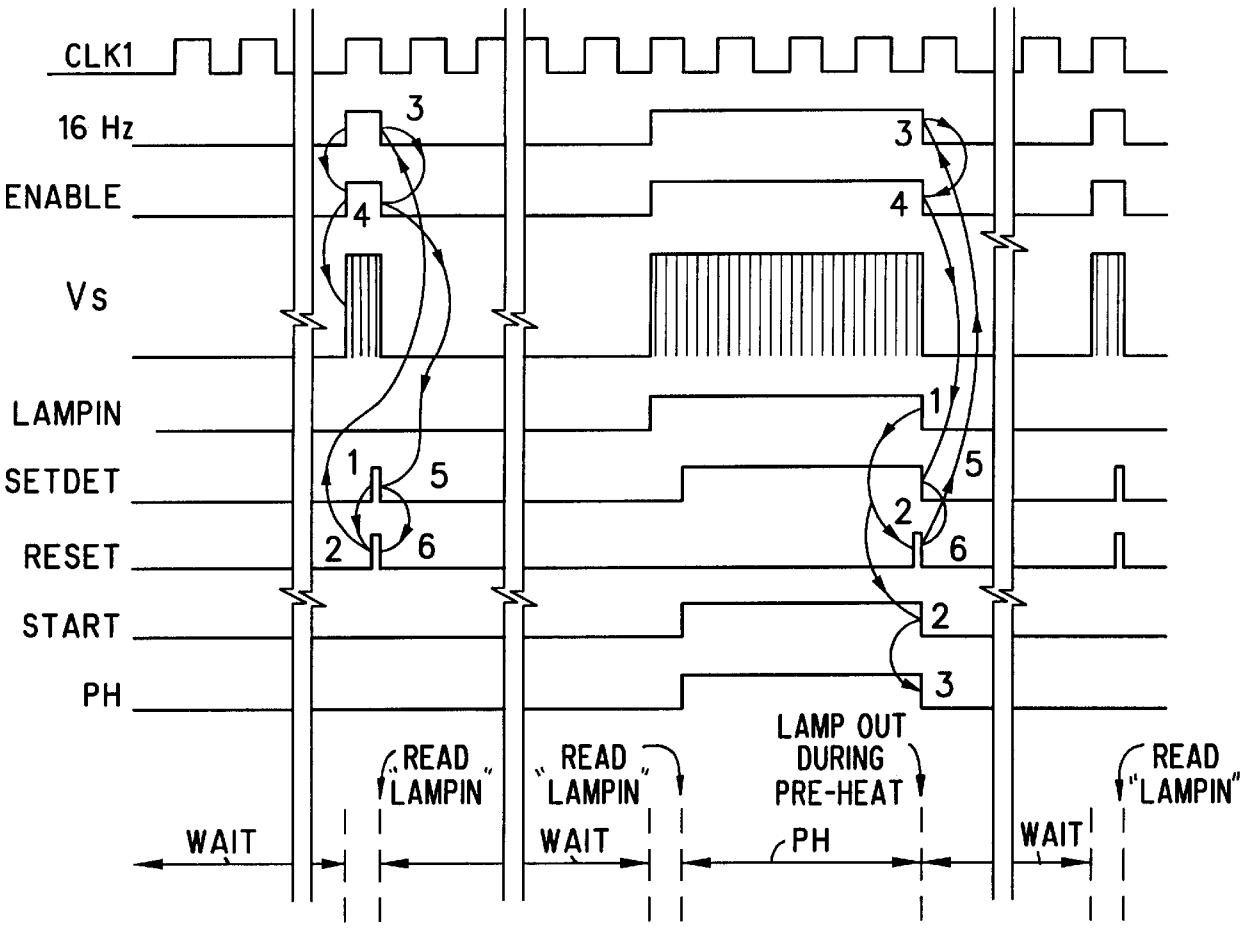
FIG. 19 is a timing diagram of the lamp presence detection circuit.

The output of DFF1 (LAMPIN) is then a digital 'high' for a lamp in and a digital 'low' for a lamp out and is an input to a Burst Logic Block (FIG. 15) whose circuit is shown in greater detail in FIG. 17. This Burst Logic Block outputs a 'Start' and 'Reset' signal to a Timer Block, which, in turn, outputs a signal 'Enable' to the Driver Logic Block. The Burst Logic and Timer function together such that an internal clock (≅500 Hz) (CLK1) signal (see FIG. 19) is divided out five times until an interval of about 16 Hz is achieved. At this time, 'Enable' goes 'high', enabling the Driver Logic to drive the Half-Bridge Driver and therefore MOSFETs/IGBTs 20 and 21 accordingly. At the next edge of signal 'CLK1' (about 250 Hz later), 'Setdet' goes 'high', instructing the Burst Logic to read signal 'Lampin'. If 'Lampin' is 'high', then a lamp presence is detected and the system continues operating. 'Start' signal goes 'high' which latches both the 'Setdet' and 'Enable' signals 'high' and the pre-heat interval of the Timer block begins (see FIG. 18 for Timer circuit). If 'Lampin' is instead 'low' when 'Setdet' goes 'high', then the 'Reset' signal goes high and resets the Timer. When the Timer is reset the 'Enable' goes 'low' and the half-bridge driver turns off, therefore turning MOSFETs/IGBTs 20 and 21 off. When 'Enable' goes 'low', it also frees the latch on 'Setdet', which then goes low.

When 'Setdet' goes low, 'Reset' also goes low and the Timer begins counting again, until the interval of 16 Hz is once again achieved and 'Lampin' is read. This 'burst' mode process of waiting-enable-measure-wait continues until a lamp is inserted. Furthermore, because 'Setdet' is latched 'high' when a lamp is detected, at any time during operation should the lamp be removed and 'Lampin' signal goes 'low', then 'Enable' goes 'low' and MOSFETs/IGBTs 20 and 21 are turned off and 'burst' mode begins.

Because of the series connection of the lamp cathodes in the lamp resonant circuit, if any of the cathodes (or both) should break during operation, the lamp presence detection circuit will read 'Lampin' signal as 'low' and go into burst mode until a new lamp is inserted. Furthermore, should the end of life phenomenon of the lamp known as the 'rectifying effect' occur, where one cathode breaks but the other cathode continues to emit, the current flowing through resistor 'RCS' goes asymmetrical and below 'Vth' therefore turning the MOSFETs/IGBTs 20 and 21 off and the system goes into the burst mode.

3. Multiple Lamp Presence Detection Circuit

The first embodiment of the ballast driver IC of the present invention, which is adapted to drive multiple fluorescent lamps, advantageously includes multiple lamp presence detection circuitry.

The multiple lamp presence detection circuit detects the presence of each individual lamp and regulates the lamp power in one of them. If the regulated lamp is removed during running, the circuit searches for the next available lamp to regulate. If the removed lamp is reinserted during running, the ballast control circuit disables the half-bridge transistor switches 20 and 21, and resets the pre-heat sequence before starting again. If all lamps are removed from the lamp resonant output circuit (see FIGS. 6A–6D), the half-bridge driver 30 is disabled and both half-bridge switches 20 and 21 turn off.

Figure 20:
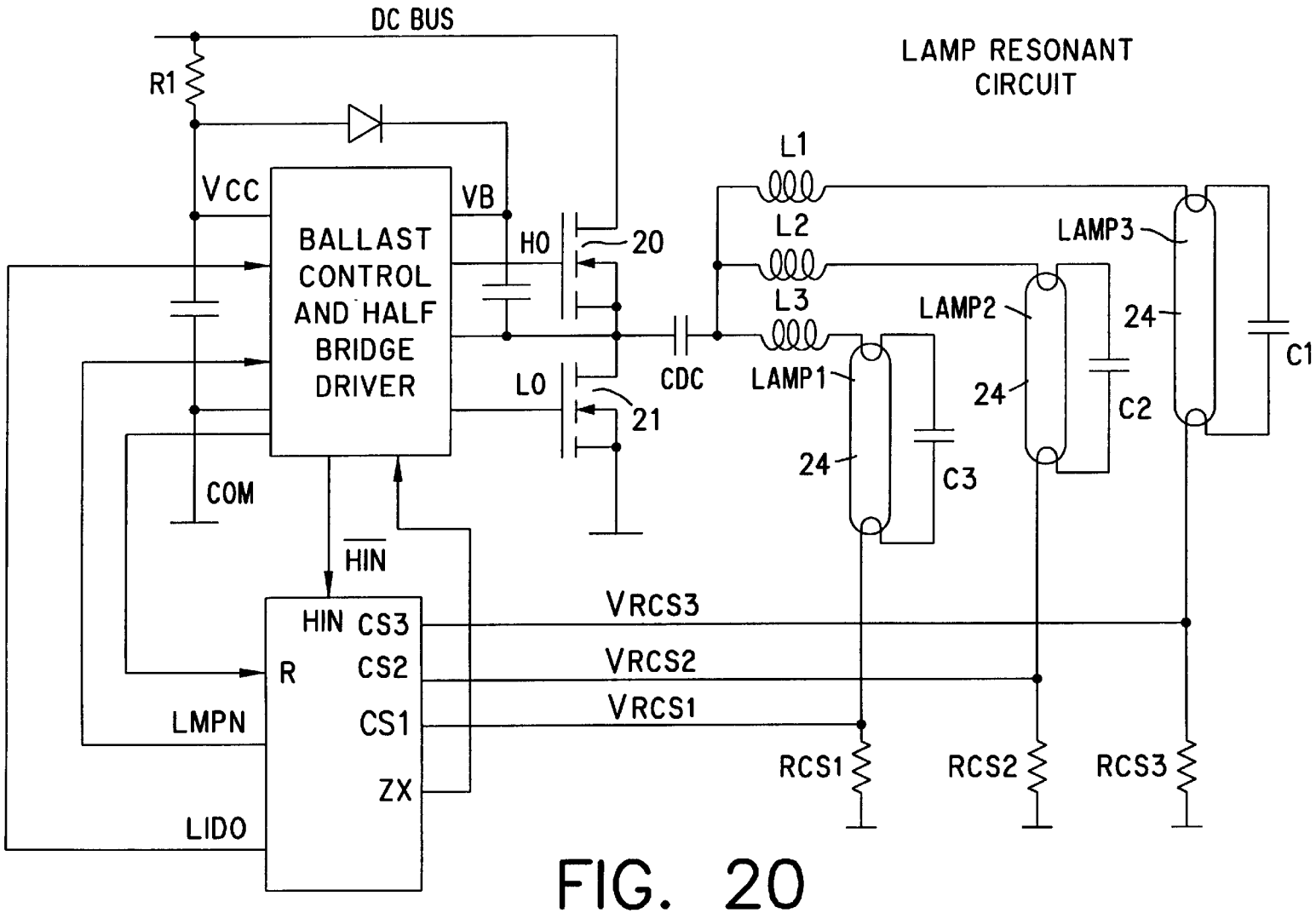
FIG. 20 is a schematic diagram showing the multiple lamp presence detection circuit in conjunction with a triple parallel lamp configuration and the ballast driver circuit.
Figure 21:
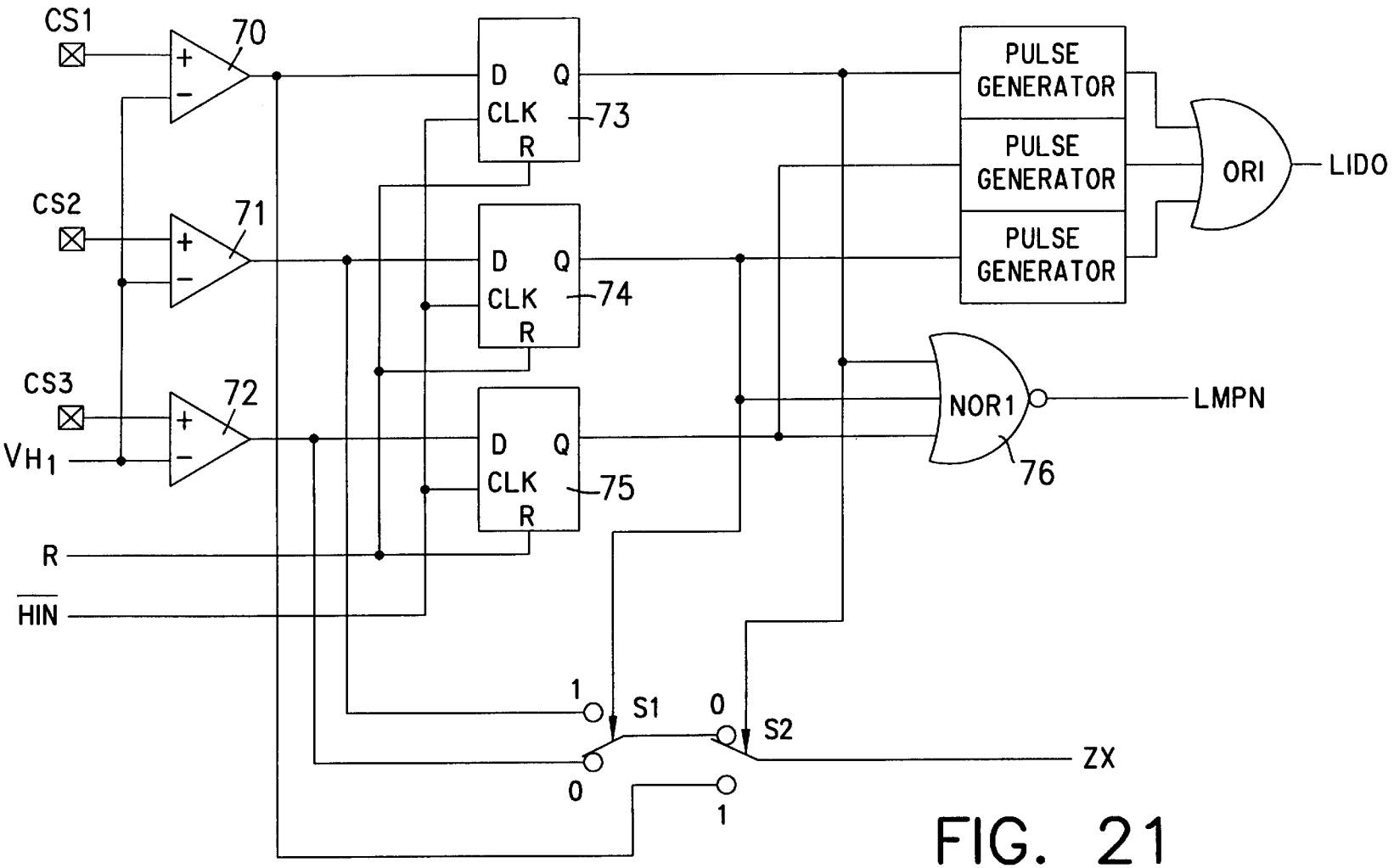
FIG. 21 shows the details of the multiple lamp detection circuit.
Figure 22A:
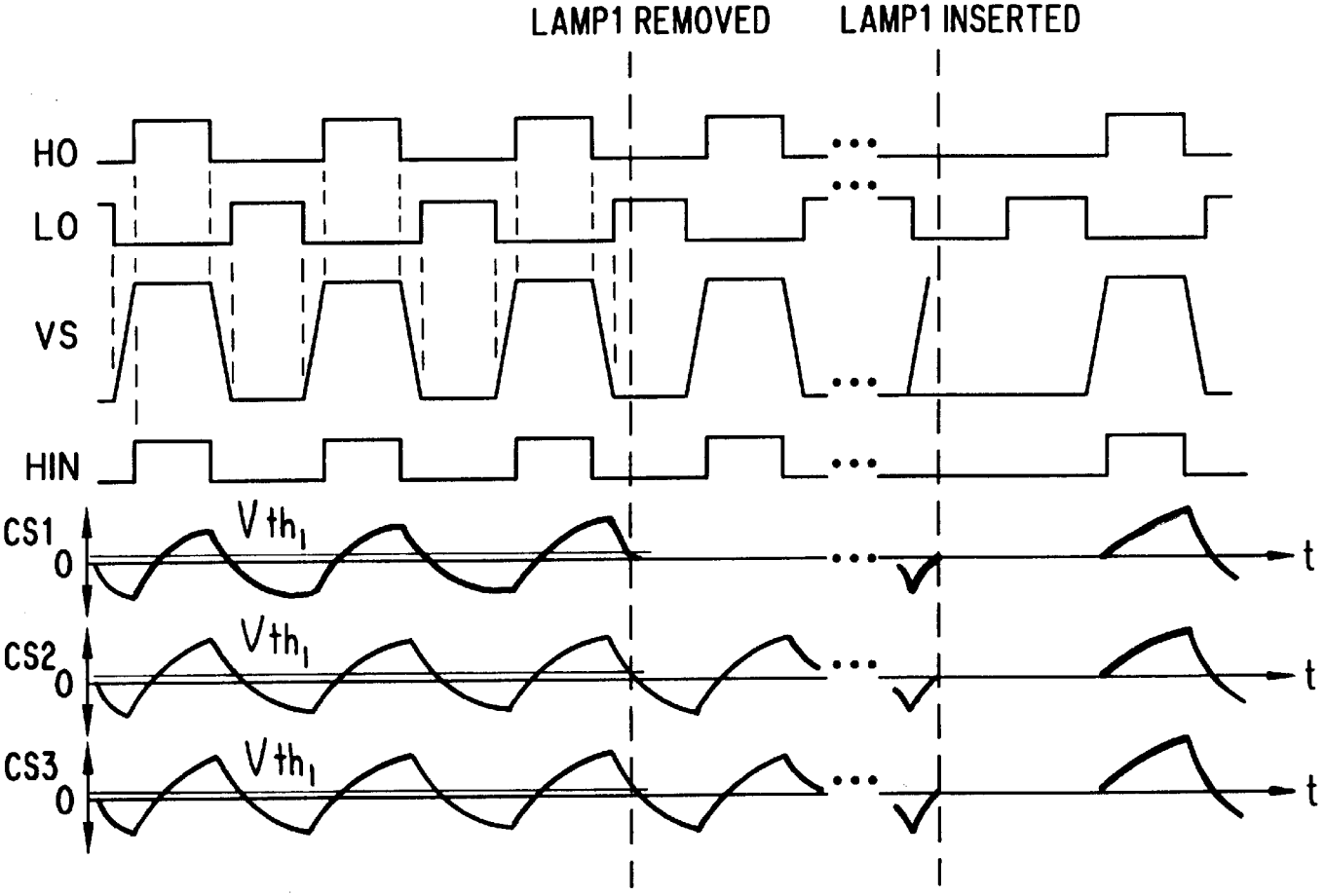
FIG. 22 is a timing diagram of the multiple lamp presence detection circuit.
Figure 22B:
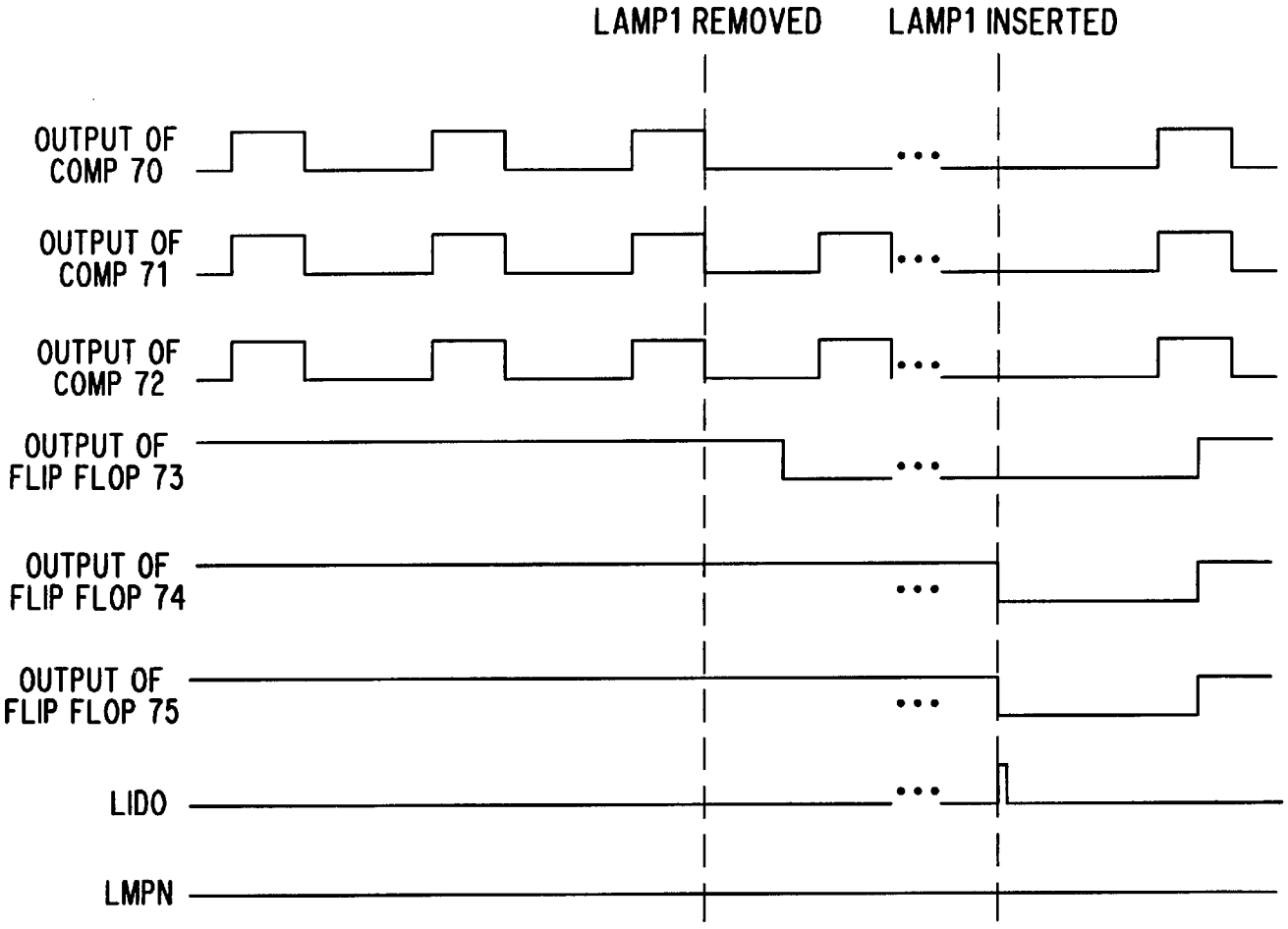

Referring to FIG. 20 (which corresponds to the triple parallel lamp configuration of FIG. 6C), a sense resistor (RCS1, RCS2, RCS3) is disposed between each lamp filament and ground to detect the total current of each lamp resonant circuit. If any lamp filament is removed then the voltage over the sense resistor in that path $V_{RCS1}$, $V_{RCS2}$, $V_{RCS3}$ goes to zero. By comparing each current sense input with a low threshold voltage ($V_{th1}$) with comparators 70, 71, 72, and measuring just before the gate drive signal HO turns the upper half-bridge switch 20 off by clocking a D-Type Flip Flop 73, 74, 75 with HIN (see circuit diagram, FIG. 21, and timing diagram, FIG. 22), a signal is generated which is indicative of a complete circuit in each lamp resonant circuit and therefore of all lamp cathodes intact and inserted in the circuit.

Each current sense input is clocked with HIN since the current flow direction through each sense resistor is at its peak when the upper half-bridge switch 20 turns off. This blanks out all other unwanted current spikes and/or noise which may be present at other times during the switching period.

The Q outputs from the D Flip Flops 73, 74, 75 are then NOR-ed together (in NOR gate 76) to form signal LMPN, which goes 'high' only if all lamp resonant circuits do not have a complete circuit (all lamps removed or all have broken cathodes) and the ballast control latches the half-bridge switches 20 and 21 off. If a single lamp is removed and reinserted, the appropriate pulse generator gives a reset pulse LIDO (Lamp Inserted During Operation) when the lamp is reinserted and the ballast control turns the half-bridge switches off, resets the pre-heat sequence, and restarts the ballast control again. This is to prevent 'hard-striking' of the inserted lamp and possible damage to the half-bridge transistor switches 20 and 21 as a result of the running frequency being lower than the resonance frequency of the High-Q series LC combination formed when a lamp is reinserted.

For lamp power regulation, the zero-crossing (ZX) of the total load current is required from one of the lamp resonant circuits with a good lamp inserted. If the lamp which is being regulated is removed, the voltage-controlled switches (S1 and S2), controlled by the signals indicative of a lamp presence (i.e., by the outputs of D flip flops 73, 74), form a 'lamp search' circuit which uses the process of elimination to find the next available lamp to regulate. If all lamps are present then the lamp connected to CS1 is regulated. If CS1 has no lamp connected, then the zero-crossing of CS2 is regulated. If both CS1 and CS2 have no lamp connected then the zero-crossing of CS3 is regulated (see the following Truth Table):

TRUTH TABLE

| Lamps Present | FF 73 OUT | FF 14 OUT | FF 75 OUT | ZX | CONDITION |
|---|---|---|---|---|---|
| NONE | 0 | 0 | 0 | 0 | LMPN 'HIGH', BALLAST OFF |
| LAMP1 | 0 | 0 | 1 | COMP 70 OUT | LAMP1 POWER REGULATED |
| LAMP2 | 0 | 1 | 0 | COMP 71 OUT | LAMP2 POWER REGULATED |
| LAMP1 & LAMP2 | 0 | 1 | 1 | COMP 70 OUT | LAMP1 POWER REGULATED |
| LAMP3 | 1 | 0 | 0 | COMP 72 OUT | LAMP3 POWER REGULATED |
| LAMP1 & LAMP3 | 1 | 0 | 1 | COMP 70 OUT | LAMP1 POWER REGULATED |
| LAMP2 & LAMP3 | 1 | 1 | 0 | COMP 71 OUT | LAMP2 POWER REGULATED |
| ALL | 1 | 1 | 1 | COMP 70 OUT | LAMP1 POWER REGULATED |

Figure 23A:
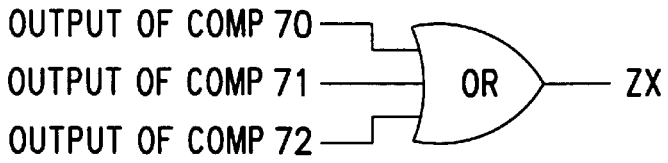
FIGS. 23A and 23B show an alternative circuit and timing diagram for the multiple lamp presence detection circuit in which two switches are replaced with an OR gate.
Figure 23B:
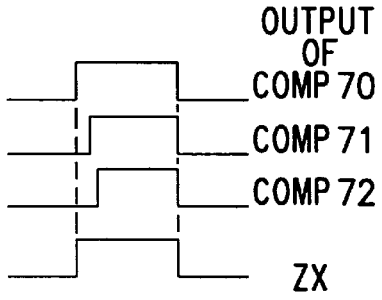

It is possible to replace switches S1 and S2 with a 3-input OR-gate as shown in FIG. 23A. In this configuration, the phase measurement (zero-crossing detection) of the resonant output stage lamp with the smallest phase-shift with respect to the half-bridge voltage will determine the pulse width of signal ZX (see FIG. 23B). This means that the lamp drawing the most power will be the master and be regulated, while the others will be the slaves and follow close by. This eliminates the need to jump to the next available lamp when the master lamp is removed and simplifies the circuit.

4. Preheat Current Control Circuit

Figure 24:
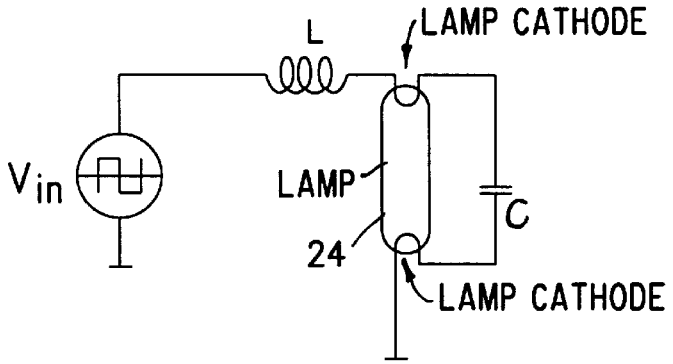
FIG. 24 shows a traditional lamp resonant circuit.

It is well known that the key to long fluorescent lamp life is to correctly pre-heat the lamp cathodes to their correct emission temperature before igniting the lamp. This is usually accomplished with a traditional resonant circuit (FIG. 24) in which the circuit is driven at a frequency corresponding to a desired current flowing through the lamp cathodes. This current flows for a desired length of time (≈1 sec) until the cathodes have reached their correct emission temperature. This frequency is usually fixed regardless of the tolerance range on other circuit components such as the resonant inductor (L) or resonant capacitor (C). When producing high quantities of ballasts therefore, trimming must be done on the pre-heat frequency setting to account for component tolerances and to ensure long lamp life being delivered from every ballast sold.

To avoid the time consuming procedure of trimming, a closed-loop solution can be used which adjusts the pre-heat frequency continuously while keeping the pre-heat current constant. Furthermore, closing the loop also allows for a simpler oscillator circuit with larger tolerances rather than with open-loop circuits which require tighter tolerance specifications.

Closing the loop requires 'feeding back' a measurement of the cathode current and comparing it against a current setting or 'reference'. The result is usually called the 'error', which is used to adjust the system until the reference equals the feedback and the error is zero. The system is then independent of outside influences such as component tolerances, voltage fluctuations and temperature.

The closed-loop pre-heat current control circuit for an electronic ballast of the present invention (employed in both embodiments of the invention) uses the same classical approach described above, but the implementation and control circuitry is new and unique. The pre-heat cathode current is sensed in the source of MOSFET/IGBT 21 (see FIG. 25) as the voltage drops across RCS ($V_{FB}$). This signal is the total lamp resonant circuit current ($I_L$), only 90° phase shifted (FIG. 26) due to the direction of current flow through sense resistor RCS with respect to the direction of current flow through the resonant circuit ($I_L$).

Voltage $V_{FB}$ is then compared with a reference voltage 'REF' through comparator 'COMP1', with the output 'ERROR' being the associated error between the '$V_{FB}$' and 'REF'. The resulting associated error 'pulse', 'ERROR', drives an amplifier comprised of MOSFETs 78 and 79 which charges or discharges (depending on whether '$V_{FB}$' is greater than or less than) capacitor C2 with fixed current sources CHARGE and $I_{REF}$ DISCHARGE. The resulting voltage over capacitor C2, '$V_{VCO}$', then steers a voltage controlled oscillator to a higher or lower frequency, depending on whether '$V_{FB}$' is greater than or less than 'REF', at a fixed duty cycle of 50%.

The resulting signal is then used to drive a 'half-bridge driver' circuit at the desired frequency which then drives MOSFETs/IGBTs 20 and 21. The resulting high-voltage square-wave voltage 'VS' (FIG. 26) is the input to the lamp resonant output circuit which outputs a current that is a function of the frequency and amplitude of voltage 'VS'.

Figure 25:
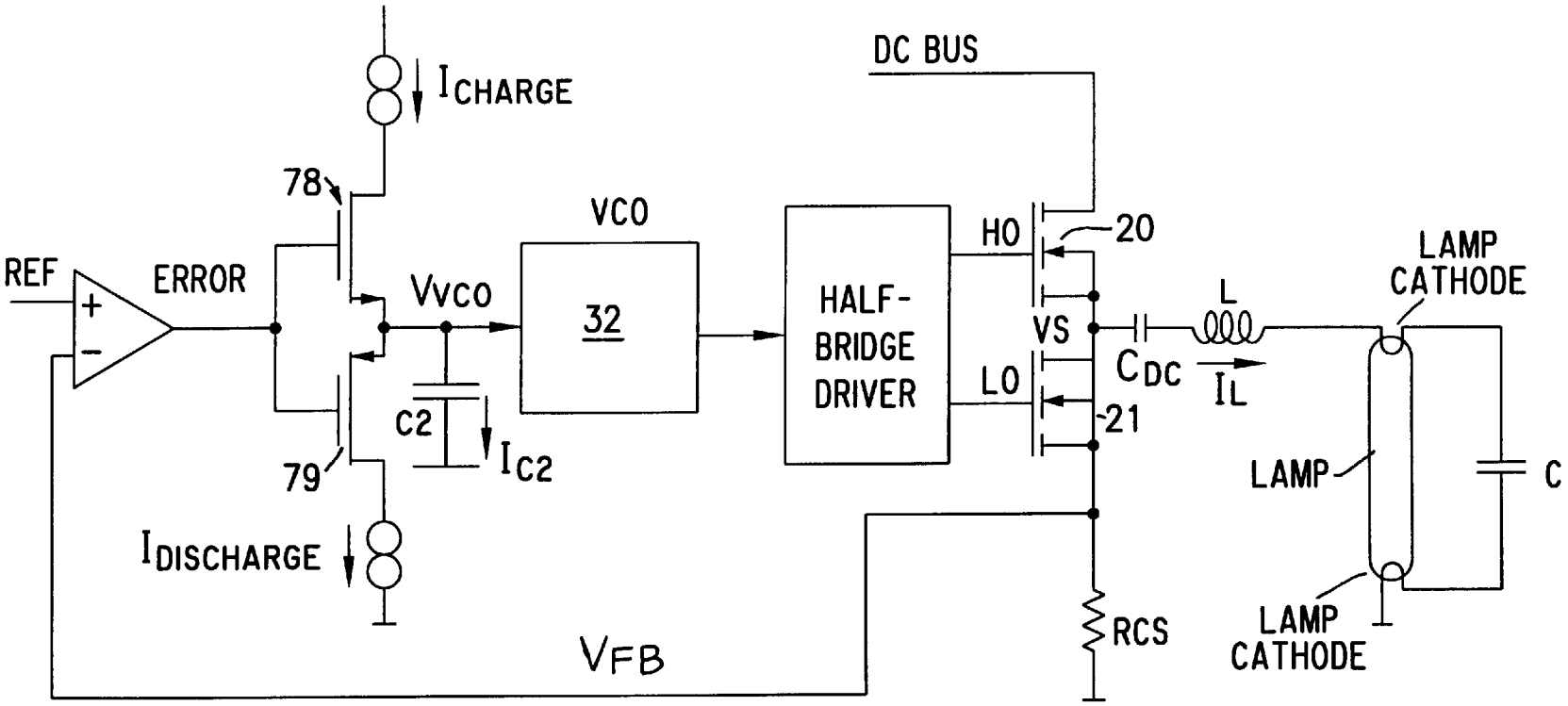
FIG. 25 shows the closed-loop pre-heat current control circuit of the present invention.
Figure 26:
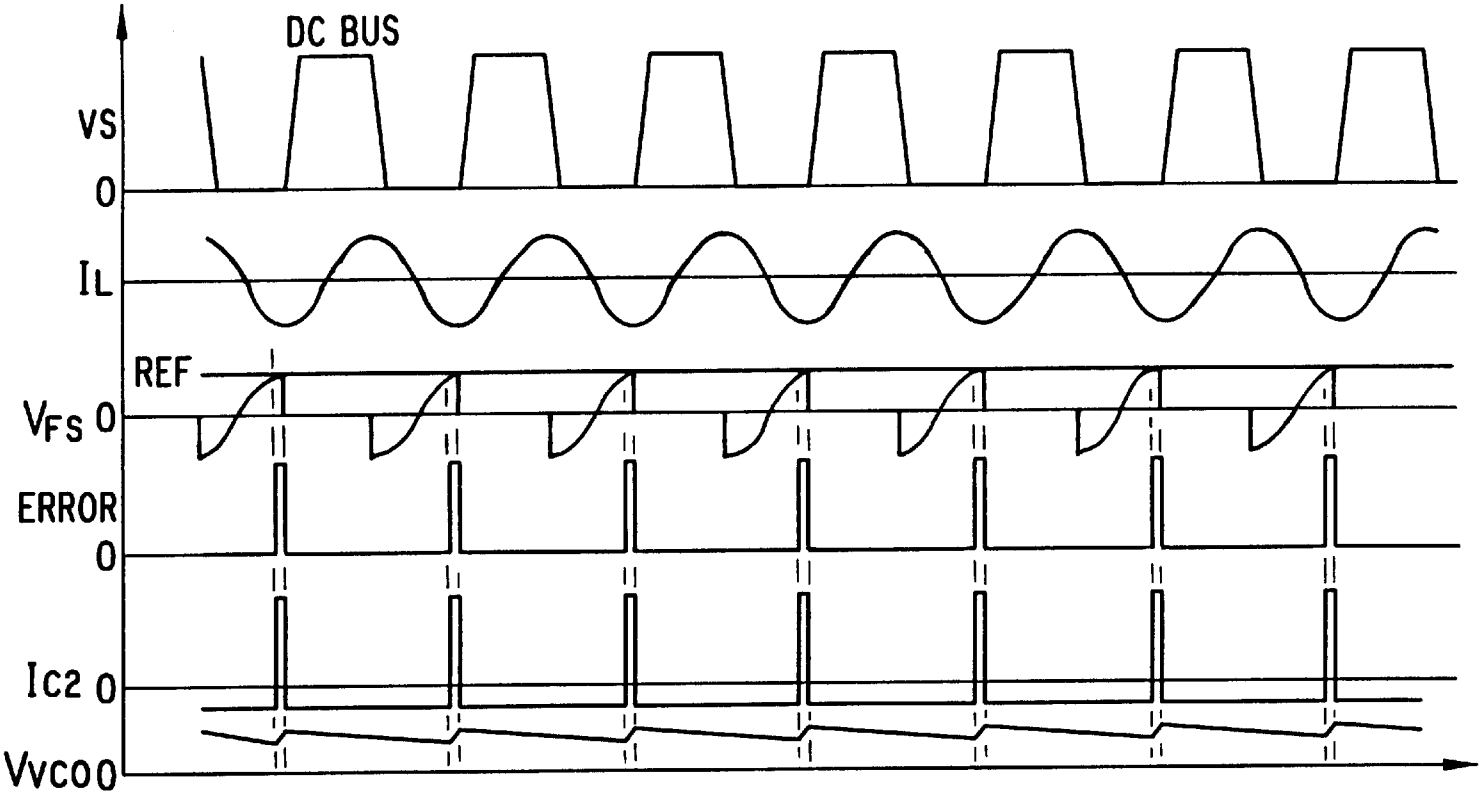
FIG. 26 shows a timing diagram of the closed-loop current control circuit of the present invention.

Important to note is that the total lamp resonant circuit current ($I_L$) is equal to the current flowing in the lamp cathodes and capacitor C (FIG. 25). This is due to the fact that during pre-heat, the lamp has not yet ignited and the circuit is an under-damped, series RCL configuration, with the lamp cathodes being connected in series with L and C.

A more classical approach to regulating the current would be to sense the current out at the load with a transformer, full wave rectify the output, and low-pass filter the rectified voltage to get a DC voltage representation of the current. This DC voltage would then be summed together with a DC reference voltage through an error amplifier of a limited bandwidth and a given compensation network. The resulting error would then steer a VCO. This method, however, has a high component count, and, the rectification of the transformer voltage (as well as the voltage drop across the rectifying diodes vs. temperature) is a non-linear operation which can give errors. The current control circuit of the present invention greatly simplifies the measurement and summing operations, has fewer components and is linear.

In summary, the preheat current control circuit of the present invention simply converts the current to reference error directly to a time. This time controls how long a constant current flows into or out of a capacitor. The resulting voltage over the capacitor C2 is already in its integrated form, as given by $$V_C = \frac{1}{C}\int i\,dt$$

All of this is achieved with a sample comparator, two MOSFETs and two current sources, easily implemented into the integrated circuit of the present invention.

5. Analog Dimming Interface Circuit

For a dimmable electronic ballast, such as the second embodiment of the present invention, it is necessary to trim the minimum and maximum brightness settings to within an allowable tolerance range such that uniform brightness is achieved with multiple ballasts. This is especially necessary at low brightness levels, where small deviations in brightness from one lamp to another are easily detectable with the human eye.

The dimming interface circuit of the present invention converts an analog input control voltage to an analog output reference voltage with programmable offset and gain adjustments for trimming. Because some fluorescent lamp types are dimmed to lower light levels than others depending on the application, the dimming interface of the present invention allows for universal trimming to any minimum and maximum brightness level (or lamp power) to accommodate all lamp types.

Figure 27:
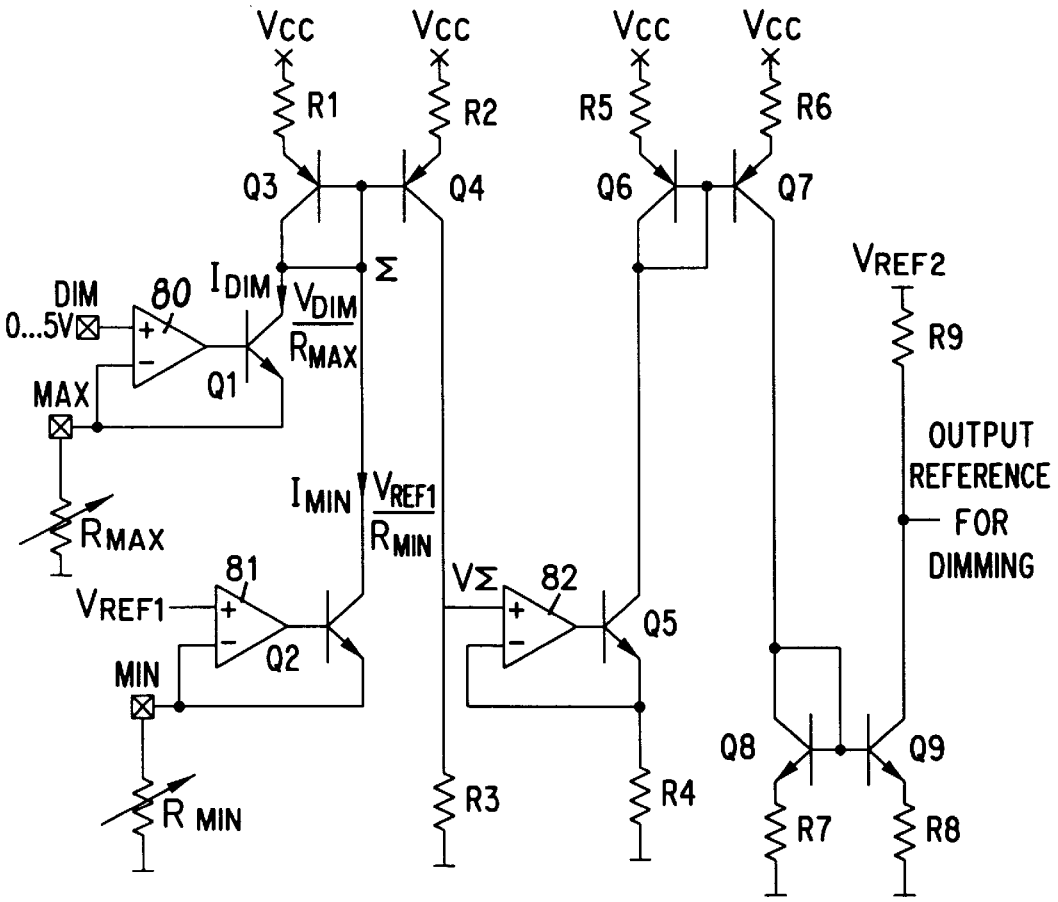
FIG. 27 shows the analog dimming interface circuit of the present invention.

The dimming interface circuit of the present invention advantageously provides independent control of the MIN and MAX settings. Referring to FIG. 27, the input voltage is at the DIM node and op amp 80 regulates the minus (−) terminal to DIM input voltage. $R_{MAX}$ and Q1 convert the DIM voltage to a current $I_{DIM}=V_{DIM}/R_{MAX}$. Adjusting $R_{MAX}$ will therefore adjust the gain of conversion from $V_{DIM}$ to $I_{DIM}$.

Figure 28:
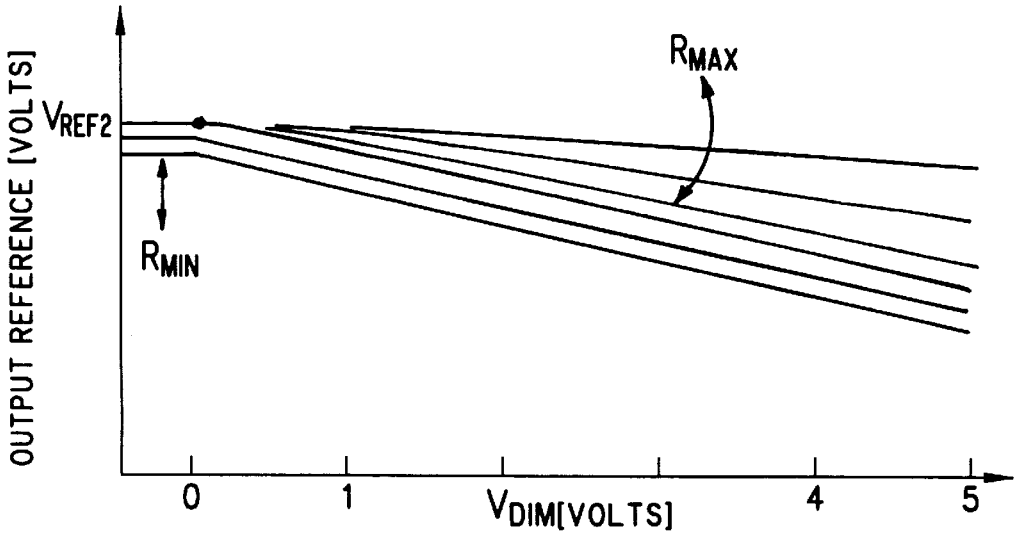
FIG. 28 shows the transfer function of the dimming interface circuit of the present invention.

A second voltage controlled current source is given by op amp 81, Q2, $R_{MIN}$ and $V_{REF1}$, where $R_{MIN}$ (with $V_{REF1}$ constant) controls the gain of $I_{MIN}$. $I_{DIM}$ and $I_{MIN}$ are then summed together at node Σ to give the mathematical expression:

$$I_\Sigma = \frac{V_{DIM}}{R_{MAX}} + \frac{V_{REF1}}{R_{MIN}}$$

therefore giving independent control of gain and offset. (FIG. 28).

The resulting current is then mirrored through current mirror R1, R2, Q3 and Q4 before flowing through R3 to produce voltage $V_{93}$ .

When implementing the circuit of the present invention in an integrated circuit, if R3 is an external resistor then the circuit would be complete and tolerances due to temperature effects would be acceptable. If the current is to be all internal to the IC, with the exception of programmable resistors $R_{MAX}$ and $R_{MIN}$, then the resistance of R3 must not change dramatically with temperature, and, for example, an additional unity gain buffer (op amp 83, Q5, R4) and current mirrors (R5, R6, Q6, Q7 and R7, R8, Q8 and Q9) can be implemented to achieve further conversions (FIG. 2).

The novelty of the circuit of the present invention resides in summing two independent currents, each controlled by a voltage and a resistor, to form an end analog function of the form:

$$y=ms+b.$$

If R3 is internal to the IC, then it must have a zero temperature coefficient so that the end reference does not change with temperature.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An integrated circuit for driving first and second MOS gated power transistors which are connected in a half bridge arrangement for supplying power to a fluorescent lamp associated with a lamp resonant circuit, the half bridge arrangement of the first and second MOS gated power transistors supplying an oscillating input voltage to the lamp resonant circuit, the input voltage having a phase, the resonant circuit having a current flowing therethrough, the current flowing through said resonant circuit having a phase, the integrated circuit comprising:

means for determining the phase of the current flowing through the lamp resonant circuit; and means for maintaining a substantially constant relationship between the phase of the input voltage and the phase of the lamp resonant circuit current, thereby regulating the lamp power.

2. The integrated circuit as recited in claim 1, wherein the phase of the resonant circuit current is determined by sensing the voltage across a sensing resistor in the lamp resonant circuit external to the integrated circuit.

3. The integrated circuit of claim 2, wherein the first and second MOS gated transistors comprise high side and low side transistors, and the sensing resistor is disposed between the low side transistor and ground.

4. The integrated circuit of claim 2, wherein the sensing resistor is disposed between the fluorescent lamp and ground.

5. The integrated circuit as recited in claim 3, wherein the integrated circuit includes overcurrent protection circuitry comprising a comparator for comparing the voltage across the sensing resistor to a reference voltage.

6. The integrated circuit as recited in claim 4, wherein the integrated circuit includes overcurrent protection circuitry comprising a comparator for comparing the voltage across the sensing resistor to a reference voltage.

7. The integrated circuit as recited in claim 6, wherein the integrated circuit includes circuitry for limiting the current flowing through the lamp resonant circuit to a predetermined level for a predetermined time before disabling the half-bridge circuit.

8. The integrated circuit as recited in claim 3, wherein the integrated circuit includes lamp presence detection circuitry comprising a comparator for comparing the voltage across the sensing resistor to a reference voltage, the lamp presence detection circuitry including:

(i) means for disabling the half bridge driver if all fluorescent lamps being driven have been removed or have broken cathodes;

(ii) means for resetting a sequence for preheating of the fluorescent lamps upon insertion of a lamp into the lamp resonant circuit during running; and (iii) means for regulating another fluorescent lamp if a fluorescent lamp being regulated is removed.

9. The integrated circuit as recited in claim 4, wherein the integrated circuit includes lamp presence detection circuitry comprising a comparator for comparing the voltage across the sensing resistor to a reference voltage, the lamp presence detection circuitry including:

(i) means for disabling the half bridge driver if all fluorescent lamps being driven have been removed or have broken cathodes;

(ii) means for resetting a sequence for preheating of the fluorescent lamps upon insertion of a lamp into the lamp resonant circuit during running; and (iii) means for regulating another fluorescent lamp if a fluorescent lamp being regulated is removed.

10. The integrated circuit as recited in claim 3, wherein the integrated circuit includes preheat current control circuitry comprising a comparator for comparing the voltage across the sensing resistor to a reference voltage.

11. The integrated circuit as recited in claim 4, wherein the integrated circuit includes preheat current control circuitry comprising a comparator for comparing the voltage across the sensing resistor to a reference voltage.

12. The integrated circuit as recited in claim 1, wherein the integrated circuit includes programmable dimming control circuitry.

13. The integrated circuit as recited in claim 12, wherein the programmable dimming control circuitry adds two independent currents, each controlled by a voltage and a resistor, to form an end analog function of the form: $y=mx+b$, the programmable dimming circuitry allowing independent resistor adjustment of minimum and maximum fluorescent lamp power settings.

14. The integrated circuit as recited in claim 2, further comprising:

means for determining zero-crossings of the lamp resonant circuit current by comparing the voltage across the sensing resistor to ground, and generating from the zero-crossings a phase pulse representing the phase of the lamp resonant circuit current as a function of time;

means for generating a reference pulse;

means for comparing the reference pulse with the phase pulse to generate an error signal indicative of the phase difference between the phase pulse and the reference pulse; and means for using the error signal to control switching frequency of the half-bridge, such that the lamp power and corresponding lamp brightness is increased or decreased as necessary to keep the phase of the lamp resonant circuit current locked to the phase of the reference pulse.

* * * * *